US008727586B2

(12) United States Patent
Wakimoto

(10) Patent No.: US 8,727,586 B2
(45) Date of Patent: May 20, 2014

(54) LIGHTING DEVICE HAVING MAGNETIC MEMBER AND MAGNET

(75) Inventor: Kenichi Wakimoto, Hokkai-do (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 249 days.

(21) Appl. No.: 13/289,720

(22) Filed: Nov. 4, 2011

(65) Prior Publication Data

US 2012/0113657 A1 May 10, 2012

(30) Foreign Application Priority Data

Nov. 5, 2010 (JP) ..... 2010-248719

(51) Int. Cl.
*F21V 21/096* (2006.01)

(52) U.S. Cl.
USPC ..... 362/398; 362/655

(58) Field of Classification Search
USPC ..... 362/398, 655, 249.02; 313/504; 248/181.2
See application file for complete search history.

(56) References Cited

U.S. PATENT DOCUMENTS

| | | | | |
|---|---|---|---|---|
| 5,962,962 | A | 10/1999 | Fujita et al. | |
| 7,806,569 | B2 * | 10/2010 | Sanroma et al. | 362/398 |
| 7,859,627 | B2 | 12/2010 | Nishida et al. | |
| 7,999,463 | B2 | 8/2011 | Nomura | |
| 2005/0258436 | A1 | 11/2005 | Arai | |
| 2008/0129184 | A1 | 6/2008 | Nishida et al. | |
| 2008/0129933 | A1 | 6/2008 | Nishida et al. | |
| 2008/0130122 | A1 | 6/2008 | Egi et al. | |
| 2010/0295443 | A1 * | 11/2010 | Roberts et al. | 313/504 |
| 2011/0006323 | A1 | 1/2011 | Suzuki et al. | |
| 2011/0089814 | A1 | 4/2011 | Nomura | |
| 2011/0089823 | A1 | 4/2011 | Nomura | |
| 2011/0101388 | A1 | 5/2011 | Nomura | |
| 2011/0134647 | A1 | 6/2011 | Nishida et al. | |
| 2011/0140617 | A1 | 6/2011 | Nomura | |
| 2012/0061707 | A1 | 3/2012 | Seo et al. | |
| 2012/0061708 | A1 | 3/2012 | Ikeda et al. | |
| 2012/0097991 | A1 | 4/2012 | Ikeda et al. | |
| 2013/0044501 | A1 * | 2/2013 | Rudisill et al. | 362/398 |

FOREIGN PATENT DOCUMENTS

| | | |
|---|---|---|
| EP | 2 264 791 A1 | 12/2010 |
| JP | 2005-317228 | 11/2005 |
| JP | 2006-108651 | 4/2006 |

(Continued)

OTHER PUBLICATIONS

Reineke, S. et al, "White Organic Light-Emitting Diodes with Fluorescent Tube Efficiency," Nature, vol. 459, May 14, 2009, pp. 234-239.

*Primary Examiner* — Karabi Guharay
(74) *Attorney, Agent, or Firm* — Husch Blackwell LLP

(57) ABSTRACT

To provide a lighting device where a light-emitting body including light-emitting elements whose light-emitting regions are spread out in a plane or light-emitting elements in which a plurality of light-emitting regions are arranged in a plane can be exchanged easily. To provide a lighting device in which a terminal of the light-emitting body can be electrically connected to a contact of a mounting portion easily. A light-emitting body including light-emitting elements whose light-emitting regions are spread out in a plane or light-emitting elements in which a plurality of light-emitting regions are arranged in a plane may be fixed by a magnetic force so that a terminal of the light-emitting body is in contact with the contact of the mounting portion.

16 Claims, 10 Drawing Sheets

(56) References Cited

FOREIGN PATENT DOCUMENTS

| | | | |
|---|---|---|---|
| JP | 2007-173424 | | 7/2007 |
| JP | 2010-218897 | | 9/2010 |
| JP | 2010-238846 | | 10/2010 |
| WO | WO 2006/030719 | A1 | 3/2006 |
| WO | WO 2009/119733 | A1 | 10/2009 |

* cited by examiner

LIGHTING DEVICE HAVING MAGNETIC MEMBER AND MAGNET

BACKGROUND OF THE INVENTION

1. Field of the Invention

The present invention relates to a lighting device.

2. Description of the Related Art

A light-emitting element including a first electrode which is spread out in a plane, a second electrode which overlaps with the first electrode, and a light-emitting layer which is interposed between the first electrode and the second electrode; and having a structure in which light emitted from the light-emitting layer is extracted to the outside through the first electrode or the second electrode has been known. Light-emitting elements having such a structure have a feature that light-emitting regions are easily spread out in a plane and a plurality of light-emitting regions are easily arranged in a plane.

As an example of a light-emitting element having such a structure, a light-emitting element using electroluminescence can be given. Specifically, a light-emitting element which has a thickness of approximately several millimeters in a sealed state and which is provided with a planar light-emitting region having several tens of centimeters square can be foamed.

Further, in Patent Document 1, the invention is described in which a light-emitting body where a plurality of light-emitting elements in each of which a light-emitting layer is provided between a first electrode and a second electrode are provided over a substrate and are connected in series is used for a lighting device.

REFERENCE

[Patent Document 1] Japanese Published Patent Application No. 2006-108651

SUMMARY OF THE INVENTION

A lighting device includes a light-emitting body. As the operating time of the light-emitting body increases, the light-emitting body deteriorates. Conventionally, a user has maintained a lighting device by renewing a light-emitting body every time the light-emitting body ends its lifetime. For example, an incandescent lamp or a fluorescent lamp is supplied to a market as a consumable product, and a user renews a light-emitting body of a light-emitting device by himself/herself.

Such a usage pattern makes it possible to continue to use a component of a lighting device which is less likely to deteriorate than a light-emitting body for a long time and to reduce waste of resources, which is rational. Accordingly, lighting devices preferably continue to be used in such a manner, and easily-exchangeable light-emitting bodies are desired.

Unlike a conventional incandescent lamp or a conventional fluorescent lamp, such a light-emitting body including light-emitting elements whose light-emitting regions are spread out in a plane or light-emitting elements in which a plurality of light-emitting regions are arranged in a plane has a smaller thickness for a light-emitting area thereof. Accordingly, it is difficult to attach the light-emitting body to a lighting device by the same method as that for attaching a conventional light-emitting body to a lighting device.

The present invention is made in view of the foregoing technical background. Accordingly, it is an object of an embodiment of the present invention to provide a lighting device where a light-emitting body including light-emitting elements whose light-emitting regions are spread out in a plane or light-emitting elements in which a plurality of light-emitting regions are arranged in a plane can be exchanged easily. Further, it is another object of an embodiment of the present invention to provide a lighting device in which a terminal of the light-emitting body can be electrically connected to a contact of a mounting portion easily.

In order to achieve any of the above-described objects, the present invention focuses on a feature that a thickness of the light-emitting body is smaller for a light-emitting area, and weight per unit area of the light-emitting area is light.

The present inventor has reached the following structure in which a light-emitting body including light-emitting elements whose light-emitting regions are spread out in a plane or light-emitting elements in which a plurality of light-emitting regions are arranged in a plane is fixed so that a terminal of the light-emitting body is in contact with a contact of a mounting portion using a magnetic force, and this structure can achieve the object.

That is, according to one embodiment of the present invention, a light-emitting body includes an optical member, a sealing member, a first terminal, a second terminal, a magnetic member fixed to the optical member or the sealing member, and a light-emitting element sealed between the optical member and the sealing member. Further, a mounting portion includes a magnet, a first contact, and a second contact. The light-emitting element of the light-emitting body includes a first electrode, a second electrode which overlaps with the first electrode, and a layer containing a light-emitting substance provided between the first electrode and the second electrode. The first electrode or the second electrode transmits light emitted from the layer containing a light-emitting substance. Further, the first electrode is electrically connected to the first terminal of the light-emitting body. The second electrode is electrically connected to the second terminal of the light-emitting body. Further, in the lighting device, the magnet of the mounting portion attracts the magnetic member of the light-emitting body, the first terminal of the light-emitting body is in contact with the first contact of the mounting portion, and the second terminal of the light-emitting body is in contact with the second contact of the mounting portion, whereby the light-emitting body is detachably fixed to the mounting portion.

According to another embodiment of the present invention, the contact of the mounting portion can be electrically connected to the light-emitting body, and the light-emitting body can be detachably fixed to the mounting portion. Thus, the light-emitting body can be exchanged easily. Further, the light-emitting body can be electrically connected to the mounting portion surely and easily.

Another embodiment of the present invention is a lighting device in which the height of the first contact or the height of the second contact is variable by contact between the light-emitting body and the first contact or the second contact.

According to another embodiment of the present invention, even in the case where variation in height of the first terminal and the second terminal is generated in manufacturing the light-emitting body, the heights of the contacts of the mounting portion are variable; therefore, the variation can be corrected. Thus, the light-emitting body can be electrically connected to the mounting portion surely and easily.

Another embodiment of the present invention is a lighting device wherein the mounting portion includes a spacer which determines a position of the light-emitting body, and wherein the height of the spacer is set so that the magnet of the mounting portion is not in contact with the light-emitting body and the distance between the magnet of the mounting portion and the magnetic member of the light-emitting body is less than or equal to 10 mm.

According to another embodiment of the present invention, the distance between the mounting portion and the light-emitting body can be constant. Accordingly, even when a plurality of the mounting portions are arranged, the heights of the light-transmitting bodies can be the same. Further, a distance is kept between the magnet and the magnetic member, whereby a rapid movement such as rapid detachment of the light-emitting body from the mounting portion or a rapid attracting of the light-emitting body to the mounting portion can be prevented in detachment or attachment of the light-emitting body, and therefore malfunction of the lighting device can be prevented.

Another embodiment of the present invention is a lighting device including the mounting portion which has a sliding mechanism in which the magnet is slid toward the magnetic member of the light-emitting body; the elastic body which distances the magnet from the magnetic member of the light-emitting body; and a switch which supplies power to the first contact and the second contact, wherein the switch is connected to the sliding mechanism, wherein when the magnetic member is close to the sliding mechanism, the magnet is slid toward the magnetic member against the stress of the elastic body, and wherein the switch is turned on and power is supplied to the light-emitting body through the first contact and the second contact.

According to another embodiment of the present invention, power supply to the first contact and the second contact in a state where the light-emitting body is not mounted on the mounting portion can be stopped. Thus, a short circuit of the first contact and the second contact can be prevented, which is safe. Further, power consumption of a driving device on which the light-emitting body is not mounted can be reduced.

Further, another embodiment of the present invention is a lighting device in which the sealing member also servers as the magnetic member.

According to another embodiment of the present invention, the number of components can be reduced. This can reduce manufacturing cost.

In this specification, in the case where a substance A is dispersed in a matrix formed using a substance B, the substance B forming the matrix is referred to as a host material, and the substance A dispersed in the matrix is referred to as a guest material. Note that the substance A and the substance B may each be a single substance or a mixture of two or more kinds of substances.

Note that a light-emitting device in this specification means an image display device, a light-emitting device, or a light source (including a lighting device). In addition, the light-emitting device includes any of the following modules in its category: a module in which a connector such as an FPC (flexible printed circuit), a TAB (tape automated bonding) tape, or a TCP (tape carrier package) is attached to a light-emitting device; a module having a TAB tape or a TCP provided with a printed wiring board at the end thereof; and a module having an IC (integrated circuit) directly mounted over a substrate over which a light-emitting element is formed by a COG (chip on glass) method.

In accordance with the present invention, a lighting device where a light-emitting body including light-emitting elements whose light-emitting regions are spread out in a plane or light-emitting elements in which a plurality of light-emitting regions are arranged in a plane can be exchanged easily can be provided. Further, a lighting device in which a terminal of the light-emitting body can be electrically connected to a contact of a mounting portion easily can be provided.

DETAILED DESCRIPTION OF THE INVENTION

Figure 1A:
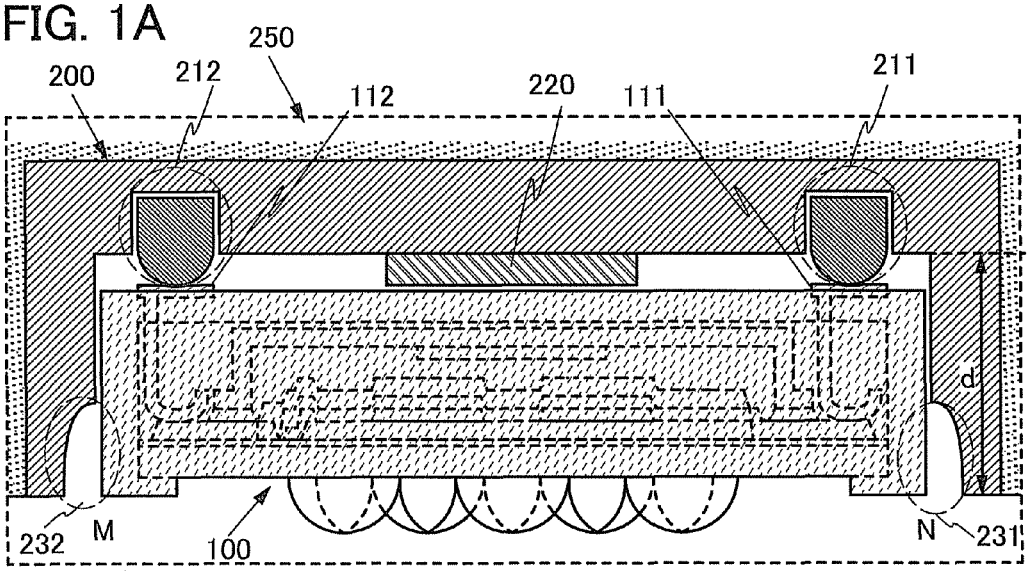
FIGS. 1A and 1B are views illustrating a lighting device according to an embodiment.

Embodiments will be described in detail with reference to the drawings. Note that the present invention is not limited to the following description, and it will be easily understood by those skilled in the art that modes and details can be modified in various ways without departing from the spirit and scope of the present invention. Therefore, the present invention should not be interpreted as being limited to the description in the following embodiments. In the structures of the present invention described below, the same portions or portions having similar functions are denoted by the same reference numerals in different drawings, and the description thereof will not be repeated.

[Embodiment 1]

In this embodiment, a lighting device to which one embodiment of the present invention is applied will be described with reference to FIGS. 1A and 1B, FIGS. 2A and 2B, and FIGS. 3A and 3B. Specifically, the lighting device includes a light-emitting body and a mounting portion to which the light-emitting body is attached. The light-emitting body includes an optical member, a sealing member, a first terminal, a second terminal, a magnetic member which is fixed to the optical member or the sealing member, and a light-emitting element which is sealed between the optical member and the sealing member. The mounting portion includes a magnet, a first contact, and a second contact. The light-emitting element of the light-emitting body includes a first electrode, a second electrode which overlaps with the first electrode, and a layer containing a light-emitting substance between the first electrode and the second electrode. The first electrode or the second electrode transmits light emitted from the layer containing a light-emitting substance. The first electrode is electrically connected to the first terminal of the light-emitting body. The second electrode is electrically connected to the second terminal of the light-emitting body. Further, in the lighting device, the light-emitting body is detachably fixed to the mounting portion in such a manner that the magnet of the mounting portion attracts the magnetic member of the light-emitting body, so that the first terminal of the light-emitting body and the second terminal of the light-emitting body are in contact with the first contact of the mounting portion and the second contact of the mounting portion, respectively. Such a lighting device will be described.

Figure 1B:
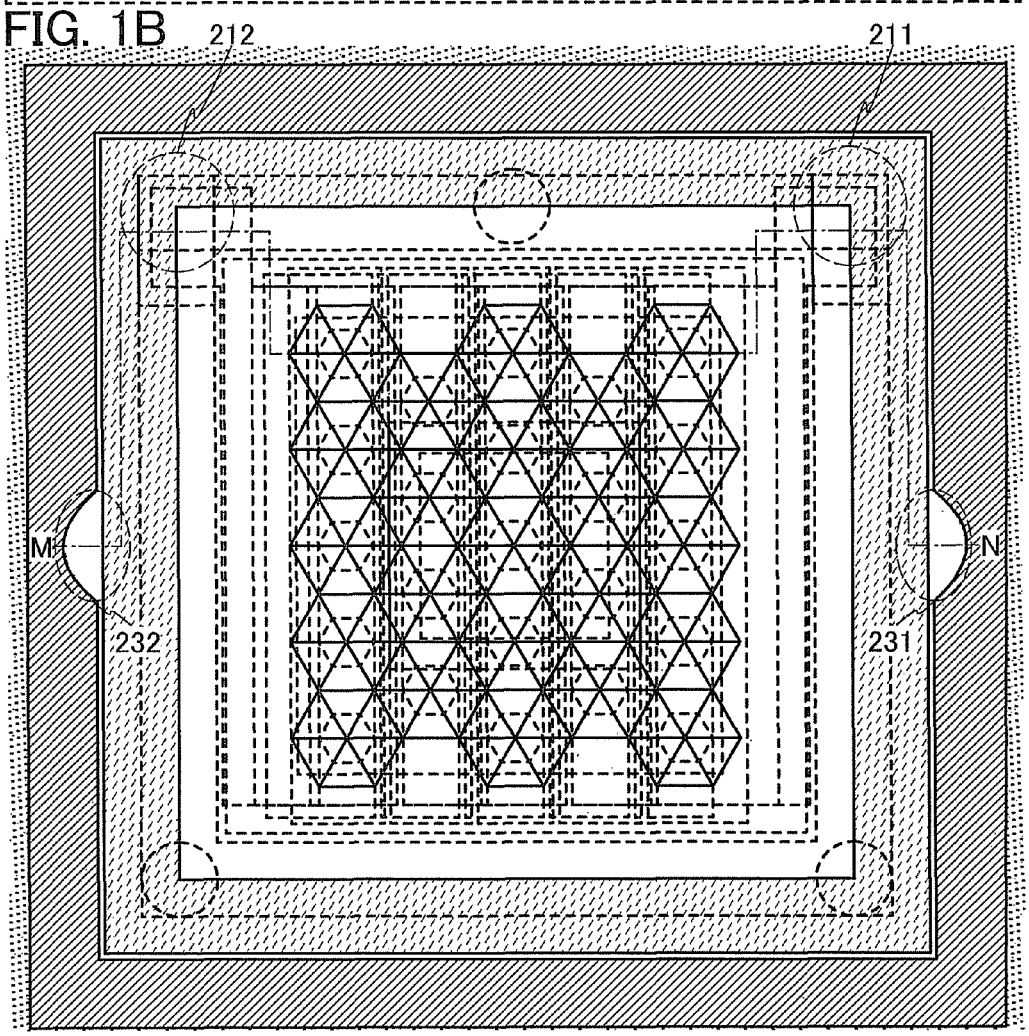

FIGS. 1A and 1B illustrate a lighting device 250 exemplified in this embodiment. FIG. 1A is a cross-sectional view of the lighting device 250, and FIG. 1B is a top view seen from a light-emitting surface side of the lighting device 250. Note that FIG. 1A corresponds to the cross-sectional view taken along section line M-N in FIG. 1B.

The lighting device 250 includes a light-emitting body 100 and a mounting portion 200. A magnet 220 included in the mounting portion 200 attracts the magnetic member of the light-emitting body 100 using a magnetic force. A first terminal 111 provided on a back side of the light-emitting body 100 which is attracted is electrically connected to a first contact 211 of the mounting portion 200. A second terminal 112 provided on the back side of the light-emitting body 100 which is attracted is electrically connected to a second contact 212 of the mounting portion 200. Note that a cut portion 231 and a cut portion 232 of the mounting portion 200 are spaces provided for inserting fingers when the light-emitting body 100 is attached to or detached from the mounting portion 200.

Figure 2A:
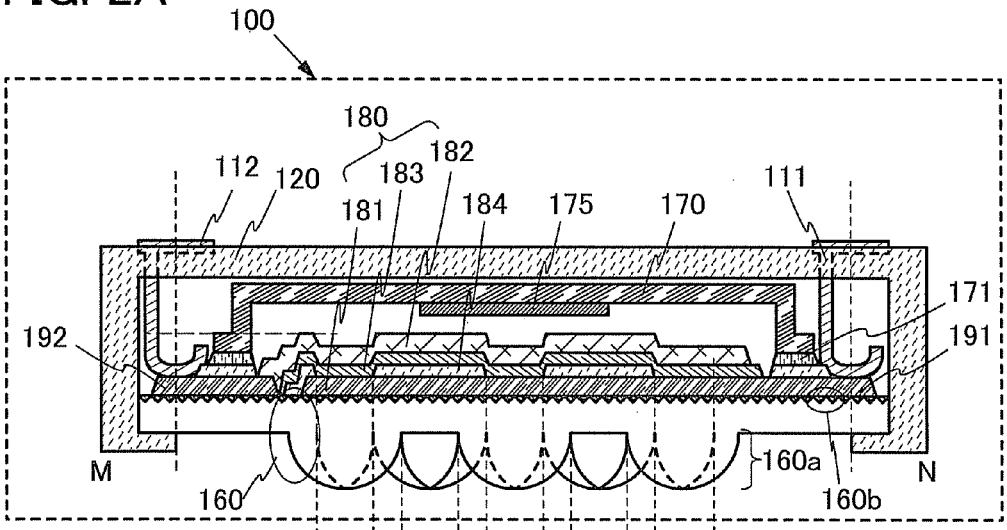
FIGS. 2A and 2B are views illustrating a light-emitting body according to an embodiment.
Figure 2B:
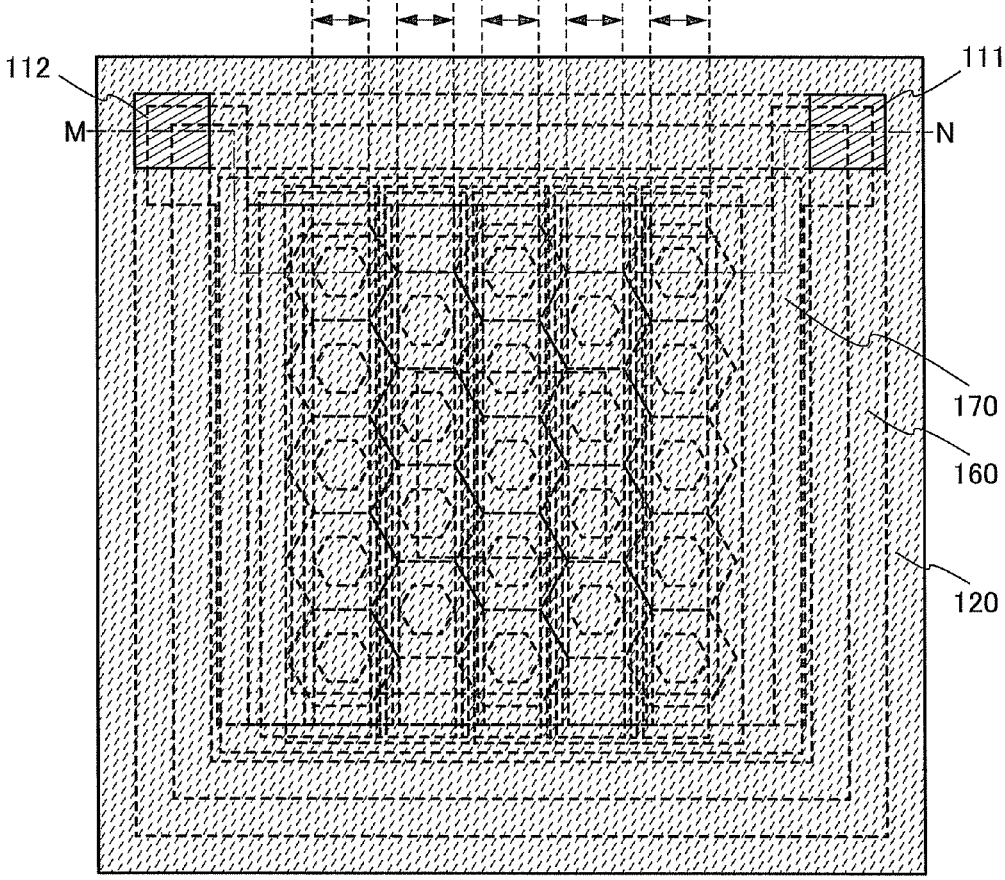

Details of the light-emitting body 100 are illustrated in FIGS. 2A and 2B. FIG. 2A is a cross-sectional view of the light-emitting body 100, and FIG. 2B is a top view seen from a non-light-emitting surface side of the light-emitting body 100. Note that FIG. 2A corresponds to the cross-sectional view taken along section line M-N in FIG. 2B.

The light-emitting body 100 exemplified in this embodiment includes an optical member 160, a sealing member 170, and a light-emitting element 180. Further, the light-emitting body 100 may be stored in an exterior portion 120. The exterior portion 120 is provided with the first terminal 111 and the second terminal 112.

The light-emitting element 180 includes a first electrode 181, a second electrode 182, and a layer 183 containing a light-emitting substance between the first electrode 181 and the second electrode 182. The first electrode 181 is formed using a conductive film which transmits light emitted from the layer 183 containing a light-emitting substance. Further, a partition 184 having an opening portion is formed over the first electrode 181. It can be said that the light-emitting element 180 is formed in the opening portion of the partition 184. A sealant 171 seals the light-emitting element 180 between the sealing member 170 and the optical member 160 so as to protect the light-emitting element 180 from the outside air.

The sealing member 170 exemplified in this embodiment is formed using a member having magnetism, and also serves as a magnetic member. The sealing member 170 also serves as a magnetic member, whereby the number of components can be reduced. This can reduce manufacturing cost.

In the case where a magnetic member is provided separately from the sealing member 170, a magnetic member may be provided on a side where the optical member 160 of the light-emitting body 100 is not provided (also referred to as a back side) or a side surface, for example, on a back side of the sealing member 170 or the exterior portion 120.

As a magnetic member, a material containing iron, cobalt, manganese, or the like can be used. For example, SUS 430 which is ferritic stainless steel, SUS420J2 which is martensite stainless steel, or the like can be used. Note that there is no particular limitation on a material used for a magnetic member as long as the light-emitting body 100 which is fixed to the magnetic member is attracted to the magnet provided in the mounting portion so that the light-emitting body 100 is not detached or dropped unintentionally while the lighting device is used.

The partition 184 of the light-emitting body 100 exemplified in this embodiment has a plurality of hexagonal openings. A plurality of hemispherical structures 160*a* are provided on a side of the optical member 160 where the light-emitting element 180 is not formed. The opening portion of the partition 184 and the hemispherical structures 160*a* are provided so as to overlap with each other (see FIG. 2B).

The partition 184 is formed using an organic insulating material or an inorganic insulating material. It is particularly preferable that the partition 184 be formed using a photosensitive resin material to have an opening portion over the first electrode 181 so that a sidewall of the opening portion is formed as a tilted surface with continuous curvature.

The space sealed by the sealant 171 may be filled with filler or a dry inert gas. Furthermore, a desiccant 175 or the like may be put between the substrate and the sealing member in order to prevent deterioration of the light-emitting element due to moisture or the like. The desiccant removes a minute amount of moisture, thereby achieving sufficient desiccation. The desiccant may be a substance which absorbs moisture by chemical adsorption such as an oxide of an alkaline earth metal as typified by calcium oxide or barium oxide. Additionally, a substance which adsorbs moisture by physical adsorption such as zeolite or silica gel may be used as well, as a desiccant.

The first electrode 181 is connected to the first terminal 111 through a first extraction terminal 191, and the second electrode 182 is connected to the second terminal 112 through a second extraction terminal 192 (see FIG. 2A).

Note that in this embodiment, the first electrode 181 is formed using a conductive film which transmits visible light. For the conductive film which transmits visible light, for example, indium oxide containing tungsten oxide, indium zinc oxide containing tungsten oxide, indium oxide containing titanium oxide, indium tin oxide containing titanium oxide, indium tin oxide (hereinafter referred to as ITO), indium zinc oxide, and indium tin oxide to which silicon oxide is added can be given. Further, a metal thin film having a thickness enough to transmit light (preferably, approximately 5 nm to 30 nm) can also be used.

Figure 3A:
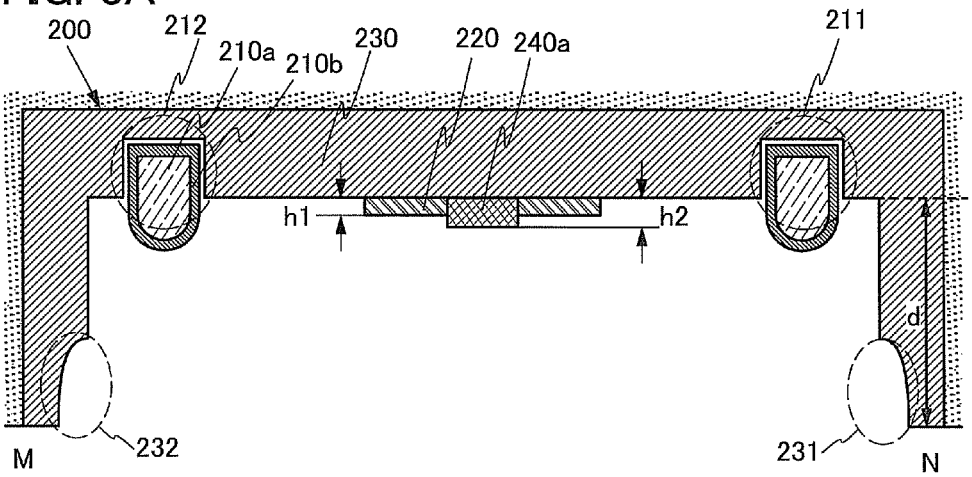
FIGS. 3A and 3B are views illustrating a mounting portion according to an embodiment.
Figure 3B:
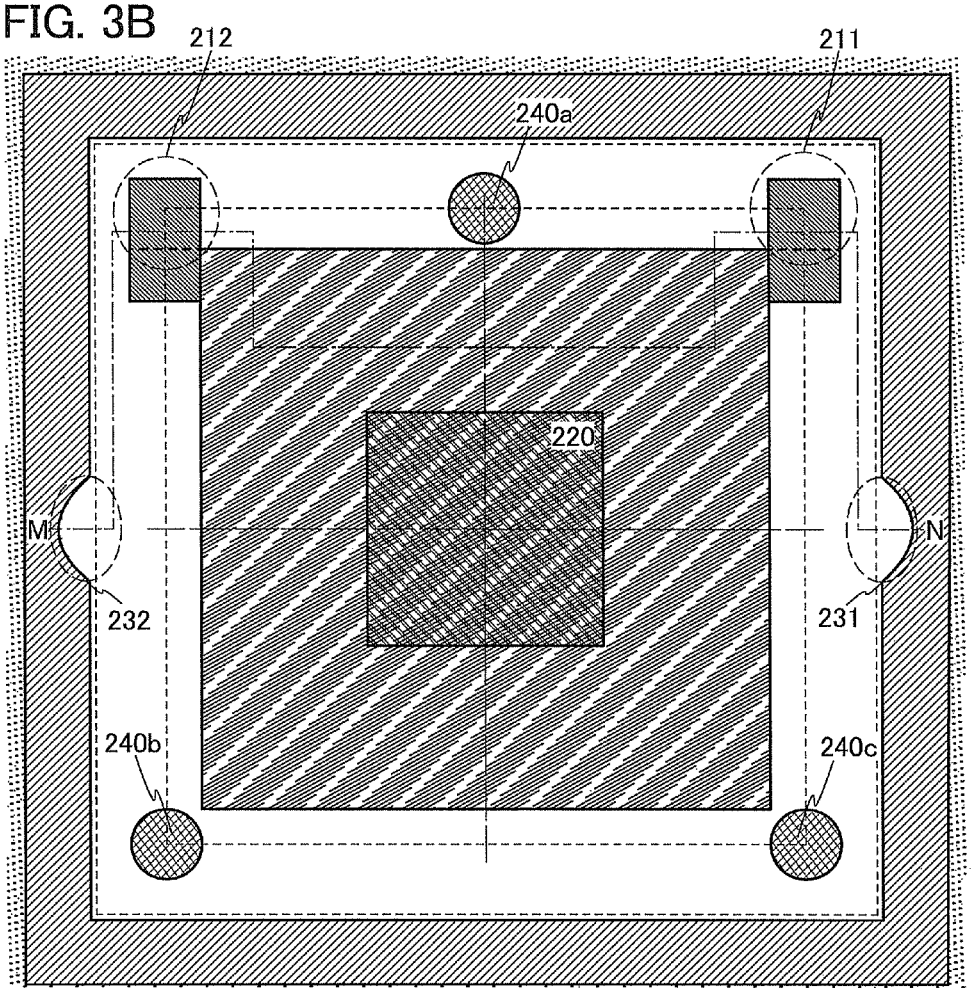

Details of the mounting portion 200 will be described with reference to FIGS. 3A and 3B. The mounting portion 200 exemplified in this embodiment includes a housing 230, the magnet 220, the first contact 211, the second contact 212, a spacer 240*a*, a spacer 240*b*, and a spacer 240*c*.

As the magnet 220 of the mounting portion 200, a permanent magnet is preferably used. Alternatively, an electromagnet or the like can be used. Examples of a permanent magnet are a ferrite magnet, a neodymium magnet, and the like. The height h1 of the magnet 220 is lower than the height h2 of the spacer 240*a*, the spacer 240*b*, and the spacer 240*c*. A back surface of the light-emitting body 100 of the lighting device 250 exemplified in this embodiment is made substantially flat. The height h1 of the magnet 220 and the heights h2 of the spacers are set in this manner, whereby an attachment position of the light-emitting body 100 by the spacers can be made uniform. Accordingly, even in the case where a plurality of mounting portions are arranged, the heights of light-emitting bodies can be the same.

The heights of the first contact 211 and the second contact 212 are preferably variable. In this embodiment, the heights of the first contact 211 and the second contact 212 are more than the height h2 of the spacer in a state where the light-emitting body 100 is not mounted.

When the light-emitting body 100 is mounted, the first contact 211 is pressed by the first terminal 111 and compressed to the same height as the spacer, and the second contact 212 is pressed by the second terminal 112 and compressed to the same height as the spacer. Such a structure is employed, whereby even when the heights of the terminals of the light-emitting body are different from each other, the difference in the heights of the first terminal and the second terminal can be corrected since the heights of the contacts are variable. Thus, the light-emitting body can be electrically connected to the mounting portion surely and easily.

As an example of a structure where the height of the contact is variable, a structure in which a plastic core material 210*a* is surrounded by a plastic conductor 210*b* can be given. As the plastic core material 210*a*, urethane foam or the like may be used. As the plastic conductor 210*b*, a conductive metal wire netting (mesh) may be used. Alternatively, a conductive elastic body whose tip is provided with a contact, such as a metallic spring, can be used for the first contact 211 and the second contact 212.

Further, in this embodiment, the structure in which the mounting portion 200 is provided with the magnet 220 and the light-emitting body 100 is provided with the magnetic member is described; however, a structure in which the mounting portion 200 is provided with a magnetic member and the light-emitting body 100 is provided with a magnet can also be employed.

Note that this embodiment can be appropriately combined with any of the other embodiments described in this specification.

[Embodiment 2]

In this embodiment, one embodiment of a lighting device different from that in Embodiment 1 will be explained with reference to FIGS. 4A and 4B. Specifically, the lighting device includes the light-emitting body and the mounting portion to which the light-emitting body is attached. The mounting portion includes a sliding mechanism in which the magnet is slid toward the magnetic member of the light-emitting body; an elastic body which distances the magnet from the magnetic member of the light-emitting body; and a switch which supplies power to the first contact and the second contact. Further, the switch is connected to the sliding mechanism. When the magnetic member is close to the sliding mechanism, the magnet is slid toward the magnetic member against the stress of the elastic body, whereby the switch is brought into electrical conduction, and power is supplied to the light-emitting body through the first contact and the second contact. Such a lighting device will be described.

Figure 4A:
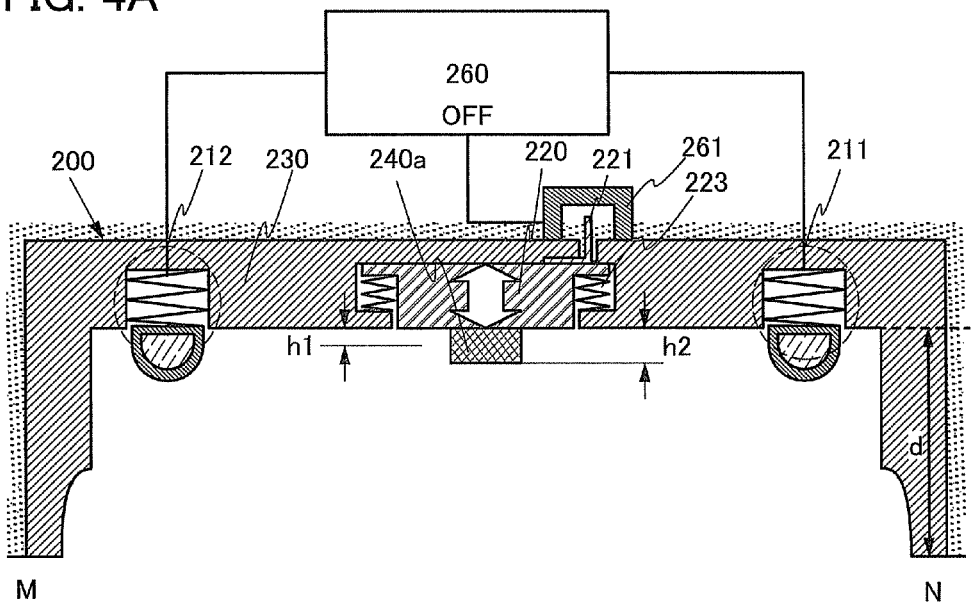
FIGS. 4A and 4B are views illustrating a lighting device according to an embodiment.
Figure 4B:
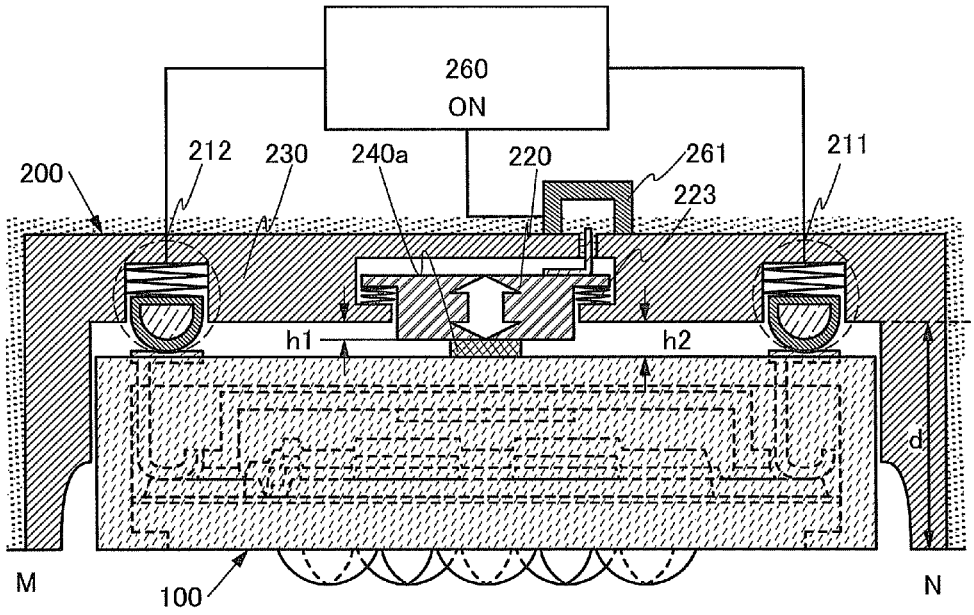

A lighting device exemplified in this embodiment is illustrated in FIGS. 4A and 4B together with a driver circuit 260 of the lighting device. FIG. 4A is a cross-sectional view of the mounting portion 200 included in the lighting device, and FIG. 4B is a cross-sectional view of the lighting device in a state where the light-emitting body 100 is mounted on the mounting portion 200.

The mounting portion 200 includes the housing 230, the first contact 211, the second contact 212, the magnet 220, and the spacer 240*a*. The magnet 220 is mounted on a depressed portion provided in the housing 230 together with an elastic body 223 so that it can be slid. Further, a light-blocking member 221 is fixed to the magnet 220. The light-blocking member 221 is provided so as to cross an optical path of the optical switch 261, and a position of the magnet 220 which is slid can be detected using the optical switch 261.

Further, the first contact 211 and the second contact 212 are electrically connected to the driver circuit 260.

The lighting device exemplified in this embodiment has a structure in which when the light-emitting body 100 is mounted on the mounting portion 200, the driver circuit 260 is started up and power is supplied from the driver circuit 260 to the light-emitting body 100. Further, the lighting device has a structure in which when the light-emitting body 100 is detached from the mounting portion 200, operation of the driver circuit is stopped. Description will be made of a mechanism in which the driver circuit is started up by mounting of the light-emitting body 100.

The magnet 220 of the mounting portion 200 is located so as to be separated from a side on which the light-emitting body is mounted by the elastic body 223. Further, the light-blocking member 221 provided for the magnet 220 is located at a position which crosses the optical path of the optical switch 261, and the optical switch 261 outputs a signal for turning off the driver circuit 260.

When the light-emitting body 100 is mounted on,the mounting portion 200, the magnet 220 is attracted to the magnetic member provided in the light-emitting body against the stress of the elastic body. The light-blocking member 221 provided for the magnet 220 moves together with the magnet 220. There is nothing for blocking the optical path of the optical switch 261, and thus, the optical switch 261 outputs a signal for turning on the driver circuit 260.

Through the above-described series of operations, the driver circuit 260 supplies power to the light-emitting body through the first contact 211 and the second contact 212.

Note that in this embodiment, the case where an optical switch is used as the optical switch 261 is described; however, the switch is not limited to the optical switch, and a mechanical switch and an electronic switch can also be used.

Further, in this embodiment, the structure where the mounting portion 200 is provided with the magnet 220 which can be slid and the light-emitting body 100 is provided with the magnetic member is exemplified. However, a structure where the mounting portion 200 is provided with a slidable magnetic member and the light-emitting body 100 is provided with a magnet can also be employed.

In accordance with this embodiment, power supply to the first contact and the second contact in a state where the light-emitting body is not mounted on the mounting portion can be stopped. Thus, short circuit of the first contact and the second contact can be prevented, which is safe. In addition, power consumption of a driving device on which the light-emitting body is not mounted can be reduced.

Note that this embodiment can be appropriately combined with any of the other embodiments described in this specification.

[Embodiment 3]

In this embodiment, a light-emitting body in which a plurality of light-emitting elements are arrayed will be described with reference to FIGS. 5A and 5B, FIGS. 6A to 6D, FIGS. 7A and 7B, and FIGS. 8A to 8C. The light-emitting body includes an optical member including a member with a low refractive index which has a hemispherical structure on a first surface and an uneven structure on a second surface and a bonding layer with a high refractive index for planarizing the uneven structure; and a light-emitting element whose light-emitting surface is in contact with a flat surface of the bonding layer with a high refractive index. The uneven structure of the member with a low refractive index is provided at least inside an outside shape of the hemispherical structure formed on the first surface. An outside shape of a light-emitting region of the light-emitting element is smaller than that of the hemispherical structure and overlaps with the hemispherical structure (see FIG. 7B).

Figure 5A:
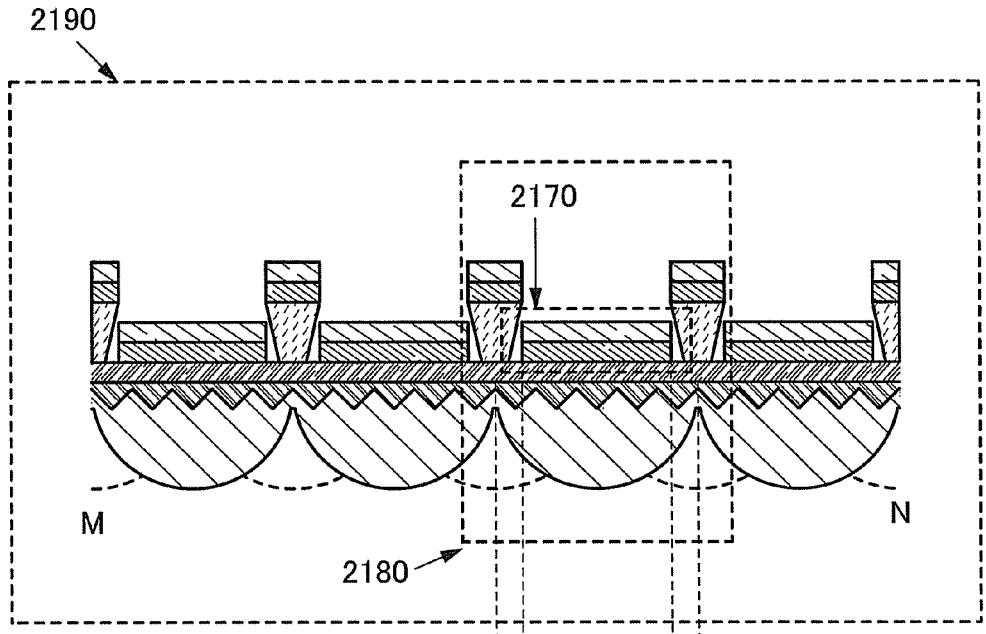
FIGS. 5A and 5B are views illustrating a light-emitting body according to an embodiment.
Figure 5B:
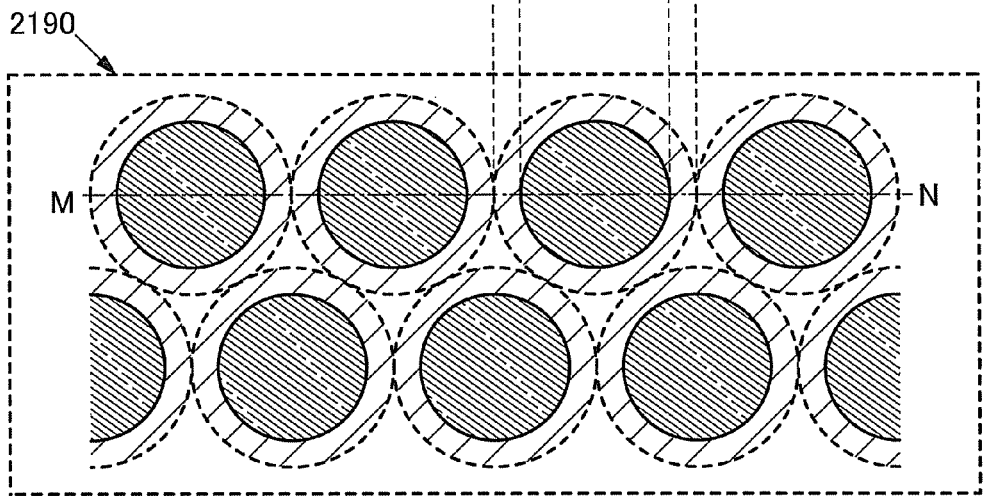

FIGS. 5A and 5B illustrate structures of the optical member and the light-emitting element included in a light-emitting body 2190. Note that the light-emitting body 2190 of this embodiment includes a plurality of small light-emitting bodies 2180 arranged in matrix. FIG. 5A is a cross-sectional view illustrating the light-emitting body 2190 in which the small light-emitting bodies 2180 are arranged in matrix, and FIG. 5B is a front view observed from a light extraction surface side of the light-emitting body 2190. Note that FIG. 5A corresponds to the cross-sectional view taken along section line M-N in FIG. 5B.

A structure of the small light-emitting body 2180 will be described in detail with reference to FIGS. 6A to 6D. The small light-emitting body 2180 includes a member 2150 with a low refractive index, a bonding layer 2160 with a high refractive index, and a light-emitting element 2170. Further, a partition 2140 is provided between the light-emitting element 2170 and an adjacent light-emitting element, and the light-emitting element 2170 is provided with a light-emitting region which is separated from an adjacent light-emitting element.

<Structure of Member with Low Refractive Index>

The member 2150 with a low refractive index has a hemispherical structure 2151 on the first surface and an uneven structure 2152 on the second surface. It is preferable that the member 2150 with a low refractive index transmit light emitted from the light-emitting element 2170 and have a refractive index of greater than 1.0 and less than 1.6. In particular, a material which transmits visible light and has a refractive index of greater than or equal to 1.4 and less than 1.6 is preferably used.

There are many kinds of materials with a refractive index of greater than 1.0 and less than 1.6, which means that such materials are easy to purchase at low cost and that the degree of freedom for selecting a material is high. Owing to the high degree of freedom for selecting a material, the degree of freedom for selecting a manufacturing method is also high, which facilitates manufacture.

The member 2150 with a low refractive index may be formed using, for example, glass or a resin. As the resin, a polyester resin, a polyacrylonitrile resin, a polyimide resin, a polymethyl methacrylate resin, a polycarbonate resin, a polyethersulfone resin, a polyamide resin, a cycloolefin resin, a polystyrene resin, a polyamide imide resin, a polyvinylchloride resin, or the like can be used.

The hemispherical structure 2151 includes an arc in a cross-section passing through a peak of the hemispherical structure 2151. For example, one mode of the hemispherical structure is a structure whose base is circular and whose cross-section passing through a peak of the structure is semicircular. Another mode of the hemispherical structure is a structure (which can be referred to as an umbrella-like structure) whose base is polygonal and whose cross-section passing through a peak of the structure includes an arc (e.g., a semicircle). A hemispherical structure whose base is a polygon with many angles is substantially the same as a hemispherical structure whose base is circular. When the base is polygonal, adjacent hemispherical structures can be arranged without a space therebetween. For example, in the case where the base of the hemispherical structure is triangular, quadrangular, or hexagonal, the hemispherical structures can be arranged with a closest packed structure on a plane. Specifically, a hemispherical structure whose base is hexagonal is preferable because such a hemispherical structure increases light extraction efficiency.

Note that a lighting device may be formed by arrangement of hemispherical structures varying in shape and size. For example, a small hemispherical structure is provided in a space between adjacent larger hemispherical structures, in which case light extraction efficiency can be increased.

In addition, some of the hemispherical (or spherical) structures may be a flatter hemispherical (or spherical) structure or the like due to a slight error in design. A shape in which total reflection can be reduced as much as possible between the hemispherical component (or the spherical component) and the air can be employed.

The uneven structure 2152 may have a regular form or an irregular form. Further, the uneven structure 2152 and an uneven structure of an adjacent small light-emitting body 2180 may be continuous or discontinuous with each other. A height from the valley to the peak of the uneven structure 2152 may be about greater than or equal to 0.1 μm and less than or equal to 100 μm and a space between adjacent peaks is preferably about greater than or equal to 1 μm and less than or equal to 100 μm. Provision of the uneven structure makes it unnecessary to use an expensive material with a high refractive index in formation of the hemispherical structure, which facilitates manufacture.

As examples of a regular form which can be employed for the uneven structure 2152, conical or pyramidal shapes such as a circular cone, a triangular pyramid, a quadrangular pyramid, and a hexagonal pyramid can be given. In particular, a triangular pyramid, a quadrangular pyramid, a hexagonal pyramid, or the like enables closest packing, which is preferable. As the uneven structures are more closely packed, a condition under which light emitted from the light-emitting element is totally reflected is less likely to be fulfilled and light extraction efficiency is increased.

Further, the uneven structure 2152 may have a single-layer structure or a structure in which a plurality of layers are stacked. For example, a structure is preferable in which an inorganic material film with a refractive index of greater than 1.0 and less than 1.6, a light-transmitting property, and a barrier property is provided at an interface with the bonding layer with a high refractive index. As the inorganic material film, a silicon oxide film or a silicon oxynitride film can be used, for example. The inorganic material film with a light-transmitting property and a barrier property can prevent diffusion of an impurity to the light-emitting element without reducing light extraction efficiency. For example, when the light-emitting element is an organic EL element, entry of an impurity such as moisture into the light-emitting element can be suppressed and the reliability of the light-emitting body can be improved.

The hemispherical structure 2151 and the uneven structure 2152 may be formed using a mold. Specifically, when the member 2150 with a low refractive index is formed by molding together the hemispherical structure 2151 and the uneven structure 2152 by injection molding or the like using the same material, a refractive index difference is less likely to be formed therebetween, so that stray light can be reduced. As a result, extraction efficiency of light emitted from the light-emitting element can be improved (see FIG. 6B).

Figure 6A:
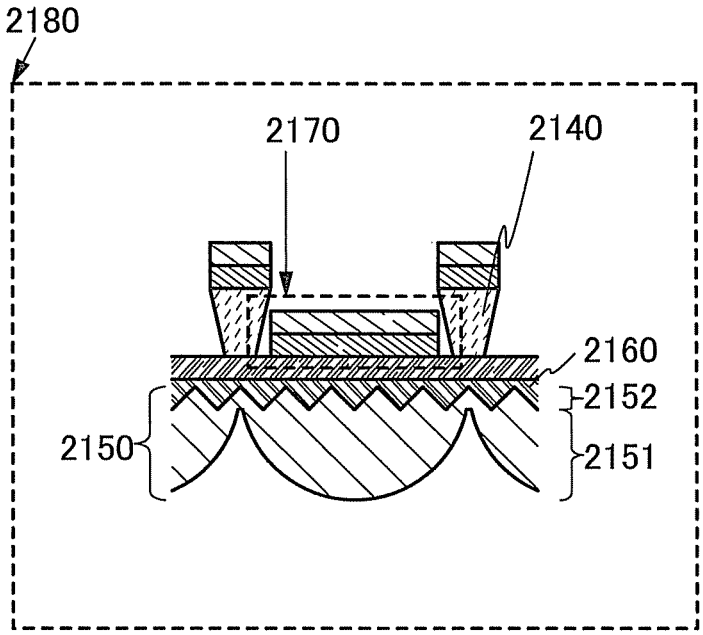
FIGS. 6A to 6D are views each illustrating a light-emitting body according to an embodiment.
Figure 6B:
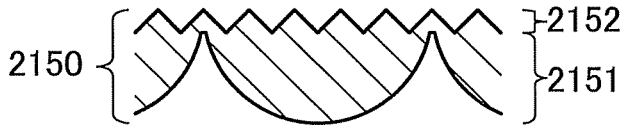
Figure 6C:
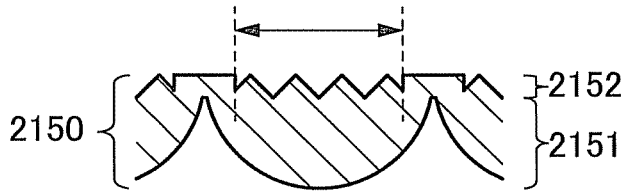

The uneven structure 2152 may be formed only in a region which overlaps with a light-emitting region of the light-emitting element 2170 (the region is indicated by an arrow in FIG. 6C). With such a structure, the mechanical strength of the member 2150 with a low refractive index can be increased.

As a method for forming the uneven structure 2152, for example, an etching method, a sand blasting method, a microblast processing method, a droplet discharge method, a printing method (screen printing or offset printing by which a pattern is formed), a coating method such as a spin coating method, a dipping method, a dispenser method, an imprint method, a nanoimprint method, or the like can be employed as appropriate.

Figure 6D:
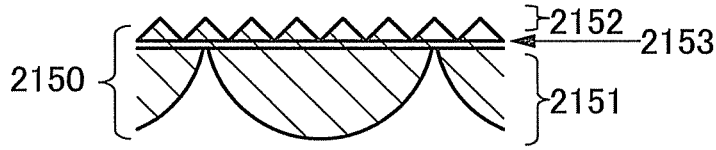

The member 2150 with a low refractive index may have a structure in which a plurality of members are combined. For example, the member with a low refractive index may have a structure in which a hemispherical structure or a microlens array is attached to one surface of a support, or a structure in which a film on which an uneven structure is formed is attached to the other surface. In FIG. 6D, an example of a structure in which the hemispherical structure 2151 is attached to a first surface of a support 2153 and the uneven structure 2152 is attached to a second surface of the support 2153 is illustrated. Note that when a plurality of members are attached, it is preferable that the members and an adhesive be made to have substantially the same refractive index (the difference in refractive indices be less than or equal to 0.15), in which case a refractive index difference inside the member 2150 with a low refractive index can be suppressed. As a result, stray light can be reduced and extraction efficiency of light emitted from the light-emitting element can be improved.

<Structure of Bonding Layer with a High Refractive Index>

One surface of the bonding layer 2160 with a high refractive index is in contact with the uneven structure 2152 of the member 2150 with a low refractive index and the other surface of the bonding layer 2160 is flat.

For the bonding layer 2160 with a high refractive index, a material which transmits light emitted from the light-emitting element 2170 and has a refractive index of greater than or equal to 1.6 is preferably used, and a material with a refractive index of greater than or equal to 1.7 and less than or equal to 2.1 is particularly preferable. When the refractive index of the material is greater than 1.6, the refractive index is almost the same as or greater than that of the light-emitting element. Therefore, even when the bonding layer 2160 is in contact with the light-emitting element through the flat surface, a condition under which light is totally reflected is less likely to be fulfilled and waveguide light is less likely to be generated, which is preferable. At the same time, the degree of freedom for selecting the material with a refractive index of greater than 1.6 is limited and such a material is relatively expensive.

However, the thickness of the bonding layer 2160 with a high refractive index exemplified in this embodiment may be set such that the uneven structure 2152 of the member 2150 with a low refractive index is filled and the surface is made flat. Thus, the use amount of an expensive material with a refractive index of greater than or equal to 1.6 can be reduced, and the bonding layer 2160 can be formed easily.

Further, the bonding layer 2160 with a high refractive index fills depressed portions of the uneven structure 2152 of the member 2150 with a low refractive index and fauns the flat surface. Accordingly, non-uniformity in film thickness, defective coverage, or the like which results from the unevenness is less likely to be caused, and the light-emitting element 2170 can be easily formed.

The bonding layer 2160 with a high refractive index is formed using glass or a resin with a high refractive index. As examples of a resin with a high refractive index, a resin containing bromine, a resin containing sulfur, and the like are given. For example, a sulfur-containing polyimide resin, an episulfide resin, a thiourethane resin, a brominated aromatic resin, or the like can be used. In addition, polyethylene terephthalate (PET), triacetyl cellulose (TAC), or the like can be used.

The bonding layer 2160 with a high refractive index may have a single-layer structure or a structure in which a plurality of layers are stacked. For example, a structure including an inorganic material film (specifically a nitride film) with a refractive index of greater than or equal to 1.6 is preferably employed. Examples of such a film include a silicon nitride film, an aluminum nitride film, a silicon nitride oxide film, an aluminum oxide film, and the like. A nitride film can prevent diffusion of an impurity to the light-emitting element without reducing light extraction efficiency. For example, when the light-emitting element is an organic EL element, entry of an impurity such as moisture into the light-emitting body can be suppressed and the reliability of the light-emitting element can be improved.

A method for forming the bonding layer 2160 with a high refractive index may be appropriately selected from a variety of methods suitable for the material in consideration of the adhesion strength, ease of processing, or the like. It is possible that any of the above-described resins is deposited by, for example, a spin coating method or a screen printing method and is cured with heat or light.

<Structure of Light-Emitting Element>

The light-emitting element 2170 includes a light-emitting layer with a refractive index of greater than or equal to 1.6. Examples of the light-emitting element 2170 are an organic EL element, an inorganic EL element, and the like.

<Structure of Small Light-Emitting Body>

A light-emitting element which produces light in a region with a refractive index higher than that of the air should have a structure for efficiently extracting light to the air. This is because, when light proceeds from a region with a high refractive index to a region with a low refractive index, light cannot be extracted to the region with a low refractive index due to total reflection at an interface between the regions.

The small light-emitting body exemplified in this embodiment includes the member with a low refractive index which has the hemispherical structure on the first surface and the uneven structure on the second surface; the bonding layer with a high refractive index which planarizes the uneven structure; and the light-emitting element whose light-emitting surface is in contact with the flat surface of the bonding layer with a high refractive index. The uneven structure of the member with a low refractive index is provided at least inside the outside shape of the hemispherical structure formed on the first surface. The light-emitting element is provided such that the outside shape of the light-emitting region of the light-emitting element is smaller than the outside shape of the hemispherical structure and overlaps with the hemispherical structure. A reason why light can be efficiently extracted from the light-emitting element with a high refractive index to the air with a low refractive index owing to the above structure will be described below with reference to FIGS. 7A and 7B.

Figure 10:
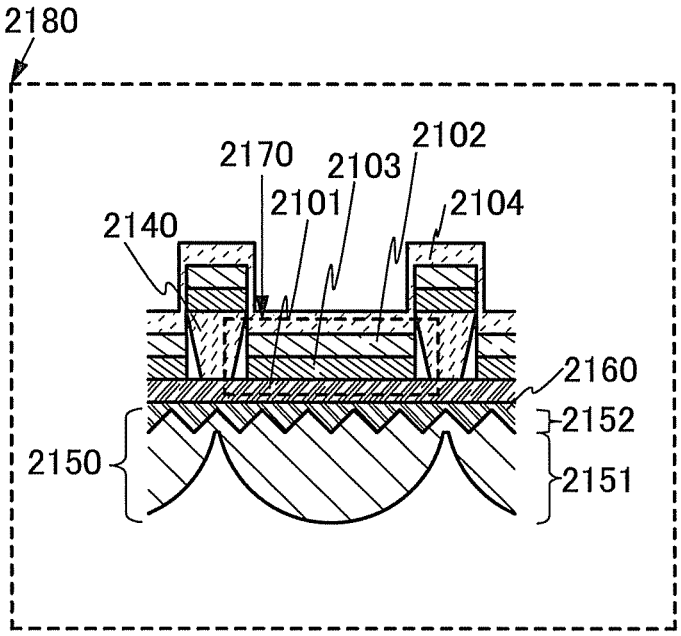
FIG. 10 is a view illustrating a small light-emitting body according to an embodiment.

In this embodiment, the case where an organic EL element is used for the light-emitting element 2170 of the small light-emitting body 2180 is described. Specifically, the light-emitting element 2170 has a structure in which a layer 2103 containing a light-emitting organic compound is interposed between a first electrode 2101 and a second electrode 2102. The first electrode 2101 transmits light emitted from the layer 2103 containing a light-emitting organic compound, which is reflected by the second electrode 2102. Further, the partition 2140 is perpendicularly formed or reverse tapered, and separates the light-emitting element 2170 from an adjacent light-emitting element (see FIG. 7A). Note that the first electrode 2101 and the second electrode 2102 are connected to a power source through respective wirings which are not shown. For example, when a conductive film 2104 is formed to overlap with the second electrode 2102 by a film formation method (e.g., sputtering) which allows favorable coverage, the second electrode 2102 of the light-emitting element 2170 can be connected to a second electrode of an adjacent light-emitting element (see FIG. 10). A similar effect can be obtained also when the second electrode 2102 is formed by a film formation method which allows favorable coverage.

Figure 7A:
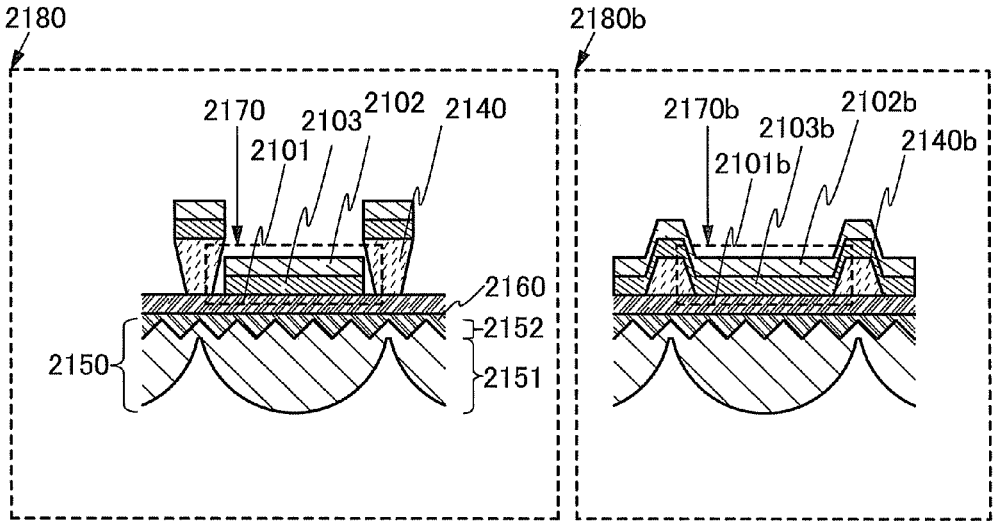
FIGS. 7A and 7B are views illustrating a light-emitting body according to an embodiment.

A modification example of the partition is illustrated in the right part of FIG. 7A. A small light-emitting body 2180*b* is provided with a forward tapered partition 2140*b*. The partition 2140*b* electrically insulates a first electrode 2101*b* from a layer 2103*b* containing a light-emitting organic compound, and separates a light-emitting element 2170*b* from an adjacent light-emitting element. Further, the forward tapered partition 2140*b* is employed, so that a second electrode 2102*b* of the light-emitting element 2170*b* can be connected to a second electrode of an adjacent light-emitting element. Note that the first electrode 2101*b* of the light-emitting element 2170*b* which is illustrated as an example in FIG. 7A is connected to a first electrode of an adjacent light-emitting element. Therefore, it can be said that the light-emitting element 2170*b* and an adjacent light-emitting body are connected in parallel.

Note that the uneven structure 2152 of the member 2150 with a low refractive index is planarized by the bonding layer 2160 with a high refractive index. By forming the first electrode 2101 over a surface planarized by the bonding layer 2160 with a high refractive index, the first electrode 2101 is formed flat, so that a short circuit of the first electrode 2101 and the second electrode 2102 can be prevented. Thus, such a structure brings about an effect of improving the reliability of the light-emitting element 2170.

In the light-emitting element 2170, the layer 2103 containing a light-emitting organic compound emits light by application of voltage greater than or equal to a threshold value on the first electrode 2101 and the second electrode 2102. Then, the light is transmitted through the first electrode 2101 with a light-transmitting property with respect to the light and proceeds to an interface with the bonding layer 2160 with a high refractive index. Note that in this specification, a region where light emission by the light-emitting element occurs is called a light-emitting region. Further, a surface where light is emitted from the light-emitting element to the bonding layer with a high refractive index is called a light-emitting surface.

Figure 7B:
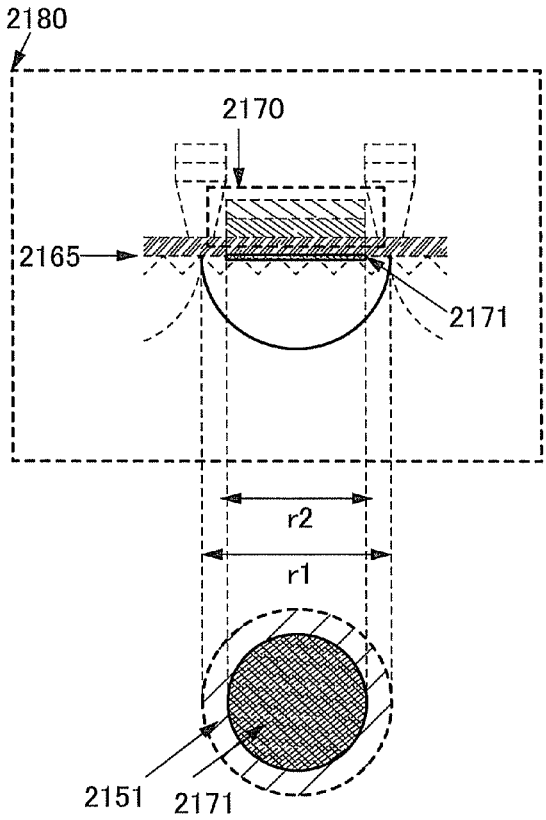

Accordingly, in FIG. 7B, an interface at which the first electrode 2101 which transmits light emitted from the light-emitting element 2170 is in contact with the bonding layer 2160 with a high refractive index is a light-emitting surface 2165. Further, a shape which is obtained by projecting the light-emitting region of the light-emitting element 2170 on the light-emitting surface 2165 is an outside shape 2171 of the light-emitting region.

Similarly to the light-emitting element 2170, the bonding layer 2160 with a high refractive index has a refractive index higher than that of the air; therefore, total reflection of much of light emitted from the light-emitting element 2170 is not caused at an interface with the bonding layer 2160 with a high refractive index, and much of the light can enter the bonding layer 2160 with a high refractive index.

The light which enters the bonding layer 2160 with a high refractive index proceeds to the uneven structure 2152 of the member 2150 with a low refractive index. Since the uneven structure 2152 has an angle which is not parallel to the light-emitting surface, total reflection is less likely to be repeated at an interface between the uneven structure 2152 and the bonding layer 2160 with a high refractive index. As a result, light emitted from the light-emitting element 2170 can enter the inside of the member 2150 with a low refractive index highly efficiently.

As illustrated in FIG. 7B, the member with a low refractive index of n has the hemispherical structure which is in contact with the air whose refractive index is further lower. Further, a diameter r2 of the outside shape 2171 of the light-emitting region of the light-emitting element 2170 is smaller than an outside shape r1 of the hemispherical structure 2151 which is projected on the light-emitting surface. In addition, the light-emitting body is provided such that the light-emitting region overlaps with the hemispherical structure 2151. Thus, light emitted from the light-emitting body is extracted through the hemispherical structure to the outside.

Especially when the outside shape 2171 of the light-emitting region and the outside shape of the hemispherical structure 2151 which is projected on the light-emitting surface 2165 are similar in shape and the size of the outside shape 2171 is included in a range (1/n) times as large as the outside shape of the hemispherical structure 2151, i.e., r2 is (1/n) times as large as r1, total reflection of light is suppressed as much as possible, and light emitted from the light-emitting body can be efficiently extracted through the hemispherical structure to the air. Light which enters a region close to a peripheral portion of the hemispherical structure 2151 is repeatedly totally reflected and hard to be extracted. Therefore, by providing the light-emitting region in a region other than that region, a reduction in extraction efficiency can be prevented.

[Modification Example]

Figure 8A:
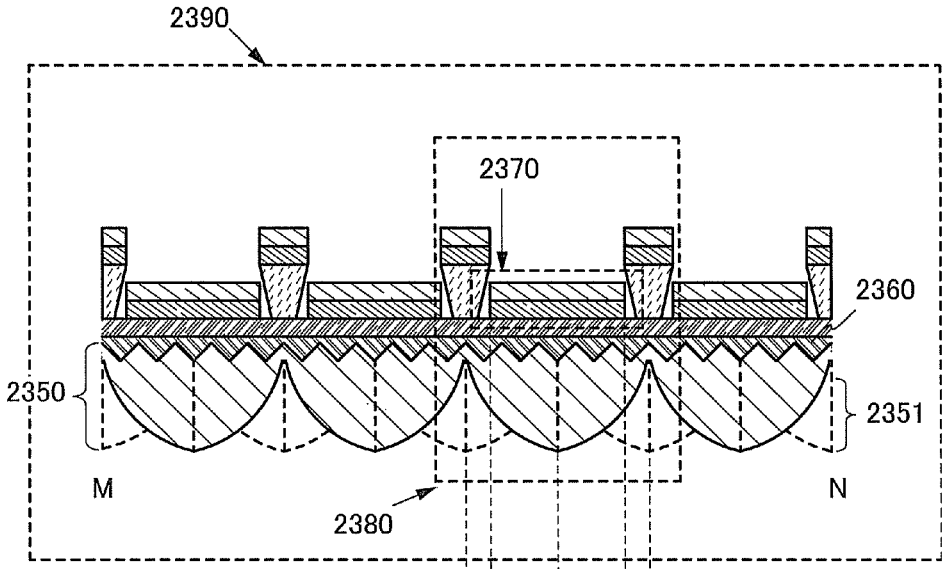
FIGS. 8A to 8C are views illustrating a light-emitting body according to an embodiment.
Figure 8B:
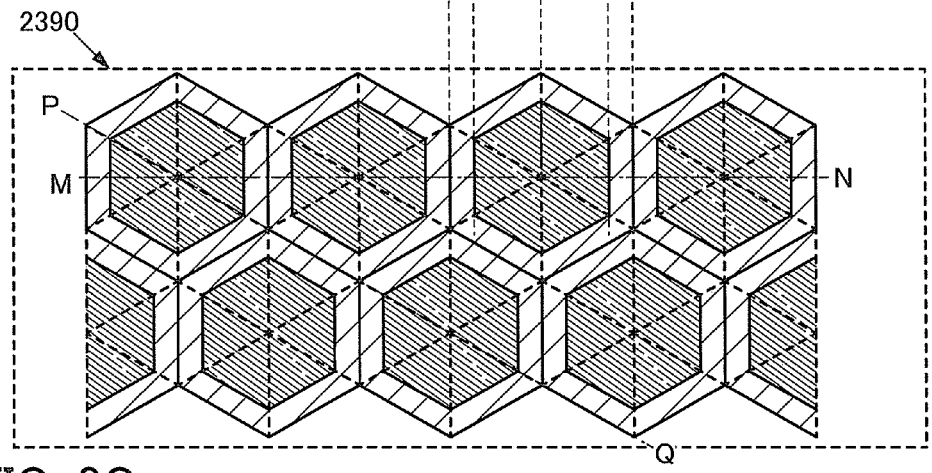
Figure 8C:
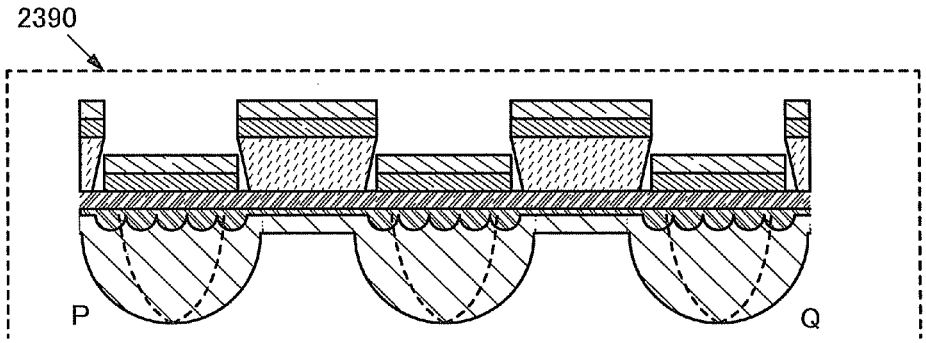

In FIGS. 8A to 8C, a modification example of this embodiment is illustrated. A light-emitting body 2390 illustrated as an example in FIGS. 8A to 8C has the same structure as the light-emitting body 2190 illustrated as an example in FIGS. 5A and 5B except that the light-emitting body 2390 is provided with a hexagonal light-emitting surface and a hemispherical structure whose base is hexagonal.

FIG. 8A is a cross-sectional view illustrating the light-emitting body 2390 in which small light-emitting bodies 2380 are arranged in matrix, and FIG. 8B is a front view observed from a light extraction surface side of the light-emitting body 2390. Note that FIG. 8A corresponds to the cross-sectional view taken along section line M-N in FIG. 8B and FIG. 8C corresponds to the cross-sectional view taken along section line P-Q in FIG. 8B.

The small light-emitting body 2380 includes a light-emitting element 2370 provided with a hexagonal light-emitting region, a bonding layer 2360 with a high refractive index, and a member 2350 with a low refractive index which has an uneven structure on a first surface and a hemispherical structure on a second surface. An outside shape of a light-emitting region which is obtained by projecting the light-emitting region of the light-emitting element 2370 on the light-emitting surface, and an outside shape of a hemispherical structure 2351 (which can also be seen as an outside shape of the base of the hemispherical structure) form concentric hexagons. Further, in the member 2350 with a low refractive index of n, the outside shape of the light-emitting region of the light-emitting element 2370 is included in a range (1/n) times as large as the outside shape of the hemispherical structure 2351.

The hemispherical structure 2351 has a ridge line from an edge of its base to its peak. In a cross-section passing through the ridge line, the ridge line includes an arc. Note that the hemispherical structure 2351 can also be referred to as an umbrella-like hemispherical structure. The light-emitting element 2370 of the small light-emitting body 2380 exemplified in this modification example has the same structure as the light-emitting element 2170 of the above small light-emitting body 2180. Specifically, a light-emitting organic compound is interposed between a first electrode and a second electrode.

Further, the first electrode and the second electrode of the light-emitting element 2370 are connected to a power source through respective wirings which are not shown. For example, when a conductive film 2304 is formed to overlap with the second electrode by a film formation method (e.g., sputtering) which allows favorable coverage, the second electrode of the light-emitting element 2370 can be connected to a second electrode of an adjacent light-emitting element. A similar effect can be obtained also when the second electrode is formed by a film formation method which allows favorable coverage.

The light-emitting body exemplified in this modification example includes a plurality of hemispherical structures on one surface, and the outside shape of the hemispherical structure is in contact with an outside shape of an adjacent hemispherical structure without a space. Further, the outside shape of the light-emitting region of the light-emitting element is included in a range (1/n) times as large as the outside shape of the hemispherical structure. With such a structure, the small light-emitting bodies can be arranged in an area with higher density, so that the light-emitting body can be reduced in size.

Specifically, the light-emitting region of the light-emitting element is provided so as to be (1/n) times as large as the outside shape of the hemispherical structure, in a region other than a peripheral portion of the hemispherical structure, in which light is less likely to be extracted; as a result, the area of the light-emitting body can be minimized without reducing light extraction efficiency. Moreover, the light extraction efficiency of the light-emitting element can be maximized.

The small light-emitting body exemplified in this embodiment includes the member with a low refractive index which has the hemispherical structure on the first surface and the uneven structure on the second surface; the bonding layer with a high refractive index which planarizes the uneven structure; and the light-emitting element whose light-emitting surface is in contact with a flat surface of the bonding layer with a high refractive index. The uneven structure of the member with a low refractive index is provided at least inside the outside shape of the hemispherical structure formed on the first surface. The small light-emitting body is provided such that the outside shape of the light-emitting region of the light-emitting element is smaller than the outside shape of the hemispherical structure and overlaps with the hemispherical structure. In the small light-emitting body, the use amount of a material with a high refractive index can be reduced; accordingly, a small light-emitting body with high light extraction efficiency can be provided with the use of an inexpensive material.

Further, the light-emitting body in which the small light-emitting bodies are arrayed includes small light-emitting bodies with high light extraction efficiency which are formed using an inexpensive material; thus, the light-emitting body is highly efficient and inexpensive.

Note that this embodiment can be appropriately combined with any of the other embodiments described in this specification.

[Embodiment 4]

In this embodiment, examples of a structure that can be applied to any of the light-emitting elements described in Embodiments 1 to 3 and a manufacturing method thereof will be described with reference to FIGS. 9A to 9C.

A light-emitting element exemplified in this embodiment includes a first electrode, a second electrode, and an organic layer containing a light-emitting substance. One of the first electrode and the second electrode serves as an anode and the other serves as a cathode. The organic layer containing a light-emitting substance is provided between the first electrode and the second electrode, and a structure of the organic layer may be appropriately selected in accordance with a material and the polarities of the first electrode and second electrode. An example of a structure of the light-emitting element will be described below; it is needless to say that the structure of the light-emitting element is not limited to this example.

<Structure Example 1 of Light-Emitting Element>

Figure 9A:
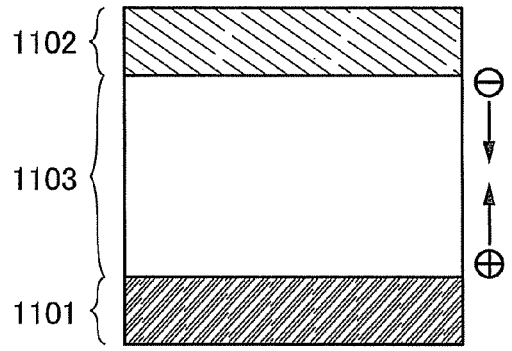
FIGS. 9A to 9C are views each illustrating a light-emitting element according to an embodiment.

An example of a structure of a light-emitting element is illustrated in FIG. 9A. In the light-emitting element illustrated in FIG. 9A, an organic layer 1103 containing a light-emitting substance is interposed between an anode 1101 and a cathode 1102.

When voltage higher than threshold voltage is applied between the anode 1101 and the cathode 1102, holes are injected to the organic layer 1103 containing a light-emitting substance from the anode 1101 side and electrons are injected to the organic layer 1103 containing a light-emitting substance from the cathode 1102 side. The injected electrons and holes are recombined in the organic layer 1103 and the light-emitting substance contained in the organic layer 1103 emits light.

The organic layer 1103 containing a light-emitting substance may include at least a light-emitting layer containing a light-emitting substance, and may have a structure in which a layer other than the light-emitting layer and the light-emitting layer are stacked. Examples of the layer other than the light-emitting layer are layers containing a substance having a high hole-injection property, a substance having a high hole-transport property, a substance having a high electron-transport property, a substance having a high electron-injection property, a substance having a bipolar property (a substance having high electron-and-hole-transport properties), and the like. Specifically, a hole-injection layer, a hole-transport layer, a light-emitting layer; a hole-blocking layer, an electron-transport layer, an electron-injection layer, and the like are given, and they can be stacked as appropriate from the anode side.

<Structure Example 2 of Light-Emitting Element>

Figure 9B:
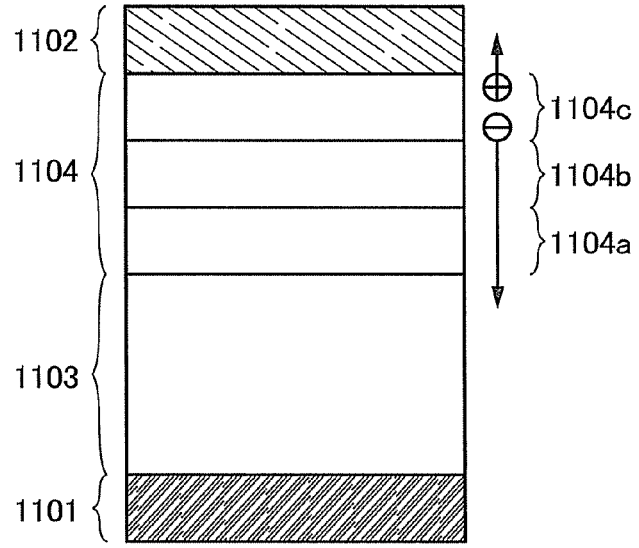

Another example of a structure of a light-emitting element is illustrated in FIG. 9B. In a light-emitting element which is illustrated as an example in FIG. 9B, the organic layer 1103 containing a light-emitting substance is interposed between the anode 1101 and the cathode 1102. Further, an intermediate layer 1104 is provided between the cathode 1102 and the organic layer 1103 containing a light-emitting substance. Note that a structure similar to that in the above structure example 1 of the light-emitting element can be applied to the organic layer 1103 containing a light-emitting substance in the structure example 2 of the light-emitting element, and for the details, the description of the structure example 1 of the light-emitting element can be referred to.

The intermediate layer 1104 may be formed to include at least a charge generation region, and may have a structure in which the charge generation region and a layer other than the charge generation region are stacked. For example, a structure can be employed in which a first charge generation region 1104*c*, an electron-relay layer 1104*b*, and an electron-injection buffer 1104*a* are stacked in that order from the cathode 1102 side.

The behaviors of electrons and holes in the intermediate layer 1104 are described. When voltage higher than threshold voltage is applied between the anode 1101 and the cathode 1102, in the first charge generation region 1104*c*, holes and electrons are generated, and the holes move into the cathode 1102 and the electrons move into the electron-relay layer 1104*b*. The electron-relay layer 1104*b* has a high electron-transport property and immediately transfers the electrons generated in the first charge generation region 1104*c* to the electron-injection buffer 1104*a*. The electron-injection buffer 1104*a* can reduce a barrier in injection of electrons into the organic layer 1103 containing a light-emitting substance, and the efficiency of the electron injection into the organic layer 1103 containing a light-emitting substance can be improved. Thus, the electrons generated in the first charge generation region 1104*c* are injected into the LUMO level of the organic layer 1103 containing a light-emitting substance through the electron-relay layer 1104*b* and the electron-injection buffer 1104*a*.

In addition, the electron-relay layer 1104*b* can prevent interaction in which the substance included in the first charge generation region 1104*c* and the substance included in the electron-injection buffer 1104*a* react with each other at the interface thereof and the functions of the first charge generation region 1104*c* and the electron-injection buffer 1104*a* are damaged.

<Structure Example 3 of Light-Emitting Element>

Figure 9C:
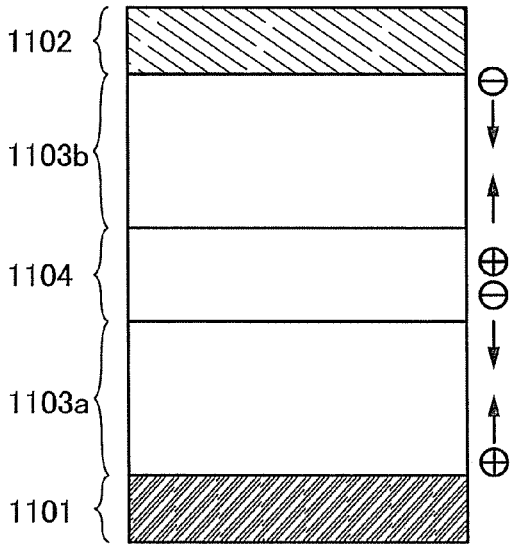

Another example of a structure of a light-emitting element is illustrated in FIG. 9C. In a light-emitting element which is illustrated as an example in FIG. 9C, two organic layers containing light-emitting substances are interposed between the anode 1101 and the cathode 1102. Further, the intermediate layer 1104 is provided between an organic layer 1103*a* containing a light-emitting substance and an organic layer 1103*b* containing a light-emitting substance. Note that the number of the organic layer containing a light-emitting substance which is interposed between the anode and the cathode is not limited to two. A structure may be employed in which three or more organic layers containing light-emitting substances are stacked between the anode and the cathode, with an intermediate layer interposed between the organic layers containing light-emitting substances. Note that a structure similar to that in the above structure example 1 of the light-emitting element can be applied to the organic layers 1103*a* and 1103*b* containing a light-emitting substance in the structure example 3 of the light-emitting element; a structure similar to that in the above structure example 2 of the light-emitting element can be applied to the intermediate layer 1104 in the structure example 3 of the light-emitting element. Thus, for the details, the description of the structure example 1 of the light-emitting element or the structure example 2 of the light-emitting element can be referred to.

The behaviors of electrons and holes in the intermediate layer 1104 provided between the organic layers containing light-emitting substances are described. When voltage higher than threshold voltage is applied between the anode 1101 and the cathode 1102, in the intermediate layer 1104, holes and electrons are generated, and the holes move into the organic layer containing a light-emitting substance which is provided on the cathode 1102 side and the electrons move into the organic layer containing a light-emitting substance which is provided on the anode 1101 side. The holes injected into the organic layer containing a light-emitting substance which is provided on the cathode side are recombined with the electrons injected from the cathode side, so that the light-emitting substance contained in the organic layer emits light. The electrons injected into the organic layer containing a light-emitting substance which is provided on the anode side are recombined with the holes injected from the anode side, so that the light-emitting substance contained in the organic layer emits light. Thus, the holes and electrons generated in the intermediate layer 1104 cause light emission in the respective organic layers containing light-emitting substances.

Note that in the case where a structure which is the same as an intermediate layer is formed between the organic layers containing light-emitting substances by providing the organic layers containing light-emitting substances that are in contact with each other, the organic layers containing light-emitting substances can be formed to be in contact with each other. Specifically, when a charge generation region is formed on one surface of the organic layer containing a light-emitting substance, the charge generation region functions as a first charge generation region of an intermediate layer; thus, the organic layers containing light-emitting substances can be formed to be in contact with each other.

The structure examples 1 to 3 of the light-emitting element can be implemented in combination. For example, an intermediate layer may be provided between the cathode and the organic layer containing a light-emitting substance in the structure example 3 of the light-emitting element.

<Material for Light-Emitting Element>

Next, specific materials that can be used for the light-emitting element having the above-described structure will be described. Materials for the anode, the cathode, the organic layer containing a light-emitting substance, the first charge generation region, the electron-relay layer, and the electron-injection buffer will be described in this order.

<Material for Anode>

The anode 1101 is preferably formed using a metal, an alloy, an electrically conductive compound, a mixture of these materials, or the like which has a high work function (specifically, a work function of greater than or equal to 4.0 eV is more preferable). Specific examples are given below: indium tin oxide (ITO), indium tin oxide containing silicon or silicon oxide, indium zinc oxide (IZO), and indium oxide containing tungsten oxide and zinc oxide.

Films of these conductive metal oxides are usually formed by sputtering; however, a sol-gel method or the like may also be used. For example, a film of indium oxide-zinc oxide (IZO) can be formed by a sputtering method using a target in which zinc oxide is added to indium oxide at greater than or equal to 1 wt % and less than or equal to 20 wt %. A film of indium oxide containing tungsten oxide and zinc oxide can be formed by a sputtering method using a target in which tungsten oxide and zinc oxide are added to indium oxide at greater than or equal to 0.5 wt % and less than or equal to 5 wt % and greater than or equal to 0.1 wt % and less than or equal to 1 wt %, respectively.

Besides, as a material used for the anode 1101, the following can be given: gold (Au), platinum (Pt), nickel (Ni), tungsten (W), chromium (Cr), molybdenum (Mo), iron (Fe), cobalt (Co), copper (Cu), palladium (Pd), titanium (Ti), nitride of a metal material (e.g., titanium nitride), molybdenum oxide, vanadium oxide, ruthenium oxide, tungsten oxide, manganese oxide, titanium oxide, and the like. Alternatively, a conductive polymer such as poly(3,4-ethylenedioxythiophene)/poly(styrenesulfonic acid) (PEDOT/PSS) or polyaniline/poly(styrenesulfonic acid) (PAni/PSS) may be used.

Note that in the case where a second charge generation region is provided in contact with the anode 1101, a variety of conductive materials can be used for the anode 1101 regardless of their work functions. Specifically, besides a material which has a high work function, a material which has a low work function can also be used for the anode 1101. A material for forming the second charge generation region will be subsequently described together with a material for forming the first charge generation region.

<Material for Cathode>

In the case where the first charge generation region 1104*c* is provided between the cathode 1102 and the organic layer 1103 containing a light-emitting substance to be in contact with the cathode 1102, a variety of conductive materials can be used for the cathode 1102 regardless of their work functions.

Note that at least one of the cathode 1102 and the anode 1101 is formed using a conductive film that transmits visible light. For the conductive film which transmits visible light, for example, indium oxide containing tungsten oxide, indium zinc oxide containing tungsten oxide, indium oxide containing titanium oxide, indium tin oxide containing titanium oxide, indium tin oxide (hereinafter referred to as ITO), indium zinc oxide, and indium tin oxide to which silicon oxide is added can be given. Further, a metal thin film having a thickness enough to transmit light (preferably, approximately greater than or equal to 5 nm and less than or equal to 30 nm) can also be used.

<Material for Organic Layer Containing Light-Emitting Substance>

Specific examples of the materials for the layers included in the above organic layer 1103 containing a light-emitting substance will be described below.

The hole-injection layer is a layer containing a substance having a high hole-injection property. As the substance having a high hole-injection property, for example, molybdenum oxide, vanadium oxide, ruthenium, oxide, tungsten oxide, manganese oxide, or the like can be used. In addition, it is possible to use a phthalocyanine-based compound such as phthalocyanine ($H_2Pc$) or copper phthalocyanine (CuPc), a high molecule such as poly(3,4-ethylenedioxythiophene)/poly(styrenesulfonic acid) (PEDOT/PSS), or the like to form the hole-injection layer.

Note that the hole-injection layer may be formed using the second charge generation region. When the second charge generation region is used for the hole-injection layer, a variety of conductive materials can be used for the anode 1101 regardless of their work functions as described above. A material for forming the second charge generation region will be subsequently described together with a material for forming the first charge generation region.

The hole-transport layer is a layer that contains a substance with a high hole-transport property. As the substance having a high hole-transport property, the following can be given, for example: aromatic amine compounds such as 4,4'-bis[N-(1-naphthyl)-N-phenylamino]biphenyl (abbreviation: NPB or a-NPD), N,N'-bis(3-methylphenyl)-N,N'-diphenyl-[1,1'-biphenyl]-4,4'-diamine (abbreviation: TPD), 4-phenyl-4'-(9-phenylfluoren-9-yl)triphenylamine (abbreviation: BPAFLP)], 4,4',4"-tris(carbazol-9-yl)triphenylamine (abbreviation: TCTA), 4,4',4"-tris(N,N-diphenylamino)triphenylamine (abbreviation: TDATA), 4,4',4"-tris[N-(3-methylphenyl)-N-phenylamino]triphenylamine (abbreviation: MTDATA), and 4,4'-bis[N-(spiro-9,9'-bifluoren-2-yl)-N-phenylamino]biphenyl (abbreviation: BSPB); 3-[N-(9-phenylcarbazol-3-yl)-N-phenylamino]-9-phenylcarbazole (abbreviation: PCzPCA1); 3,6-bis[N-(9-phenylcarbazol-3-yl)-N-phenylamino]-9-phenylcarbazole (abbreviation: PCzPCA2); 3-[N-(1-naphthyl)-N-(9-phenylcarbazol-3-yl) amino]-9-phenylcarbazole (abbreviation: PCzPCN1); and the like. Alternatively, the following carbazole derivative can be used: 4,4'-di(N-carbazolyl)biphenyl (abbreviation: CBP), 1,3,5-tris[4-(N-carbazolyl)phenyl]benzene (abbreviation: TCPB), and 9-[4-(10-phenyl-9-anthracenyl)phenyl]-9H-carbazole (abbreviation: CzPA). The substances mentioned here are mainly ones that have a hole mobility of greater than or equal to $10^{-6}$ $cm^2/Vs$. However, other substances than the above described materials may also be used as long as the substances have higher hole-transport properties than electron-transport properties. The layer containing a substance with a high hole-transport property is not limited to a single layer, and two or more layers containing the aforementioned substances may be stacked.

In addition to the above substances, a high molecular compound such as poly(N-vinylcarbazole) (abbreviation: PVK), poly(4-vinyltriphenylamine) (abbreviation: PVTPA), poly[N-(4-{4-(4-diphenylamino)phenyl]phenyl-N'-phenylamino}phenyl)methacrylamide] (abbreviation: PTPDMA), or poly[N,N'-bis(4-butylphenyl)-N,N'-bis(phenyl)benzidine] (abbreviation: Poly-TPD) can be used for the hole-transport layer.

The light-emitting layer is a layer containing a light-emitting substance. As the light-emitting substance, any of the following fluorescent compounds can be used. As the light-emitting substance, the following fluorescent compound can be given, for example: N,N'-bis[4-(9H-carbazol-9-yl)phenyl]-N,N'-diphenylstilbene-4,4'-diamine (abbreviation: YGA2S); 4-(9H-carbazol-9-yl)-4'-(10-phenyl-9-anthryl) triphenylamine (abbreviation: YGAPA); 4-(9H-carbazol-9-yl)-4'-(9,10-diphenyl-2-anthryl)triphenylamine (abbreviation: 2YGAPPA); N,9-diphenyl-N-[4-(10-phenyl-9-anthryl) phenyl]-9H-carbazol-3-amine (abbreviation: PCAPA); perylene; 2,5,8,11-tetra-tert-butylperylene (abbreviation: TBP); 4-(10-phenyl-9-anthryl)-4'(9-phenyl-9H-carbazol-3-yl)triphenylamine (abbreviation: PCBAPA); N,N"-(2-tert-butylanthracene-9,10-diyldi-4,1-phenylene)bis[N,N',N'-triphenyl-1,4-phenylenediamine] (abbreviation: DPABPA); N,9-diphenyl-N-[4-(9,10-diphenyl-2-anthryl)phenyl]-9H-carbazol-3-amine (abbreviation: 2PCAPPA); N-[4-(9,10-diphenyl-2-anthryl)phenyl]-N,N',N'-triphenyl-1,4-phenylenediamine (abbreviation: 2DPAPPA); N,N,N',N',N",N",N'",N'"-octaphenyldibenzo[g,p]chrysene-2,7,10,15-tetraamine (abbreviation: DBC1); coumarin 30; N-(9,10-diphenyl-2-anthryl)-N,9-diphenyl-9H-carbazol-3-amine (abbreviation: 2PCAPA); N-[9,10-bis(1,1'-biphenyl-2-yl)-2-anthryl]-N,9-diphenyl-9H-carbazol-3-amine (abbreviation: 2PCABPhA); N-(9,10-diphenyl-2-anthryl)-N,N',N'-triphenyl-1,4-phenylenediamine (abbreviation: 2DPAPA); N-[9,10-bis(1,1'-biphenyl-2-yl)-2-anthryl]-N,N',N'-triphenyl-1,4-phenylenediamine (abbreviation: 2DPABPhA); 9,10-bis(1,1'-biphenyl-2-yl)-N-[4-(9H-carbazol-9-yl)phenyl]-N-phenylanthracen-2-amine (abbreviation: 2YGABPhA); N,N,9-triphenylanthracen-9-amine (abbreviation: DPhAPhA); coumarin 545T; N,N'-diphenylquinacridone (abbreviation: DPQd); rubrene; 5,12-bis(1,1'-biphenyl-4-yl)-6,11-diphenyltetracene (abbreviation: BPT); 2-(2-{2-[4-(dimethylamino)phenyl]ethenyl}-6-methyl-4H-pyran-4-ylidene)propanedinitrile (abbreviation: DCM1); 2-{2-methyl-6-[2-(2,3,6,7-tetrahydro-1H,5H-benzo[ij]quinolizin-9-yl)ethenyl]-4H-pyran-4-ylidene}propanedinitrile (abbreviation: DCM2); N,N,N',N'-tetrakis(4-methylphenyl)tetracene-5,11-diamine (abbreviation: p-mPhTD); 7,14-diphenyl-N,N,N',N'-tetrakis(4-methylphenyl)acenaphtho[1,2-a]fluoranthene-3,10-diamine (abbreviation: p-mPhAFD); 2-{2-isopropyl-6-[2-(1,1,7,7-tetramethyl-2,3,6,7-tetrahydro-1H,5H-benzo [ij] quinolizin-9-yl)ethenyl]-4H-pyran-4-ylidene}propanedinitrile (abbreviation: DCJTI); 2-{2-tert-butyl-6[2-(1,1,7,7-tetramethyl-2,3,6,7-tetrahydro-1H,5H-benzo[ij]quinolizin-9-yl)ethenyl]-4H-pyran-4-ylidene}propanedinitrile (abbreviation: DCJTB); 2-(2,6-bis{2-[4-(dimethylamino)phenyl]ethenyl}-4H-pyran-4-ylidene)propanedinitrile (abbreviation: BisDCM); 2-{2,6-bis[2-(8-methoxy-1,1,7,7-tetramethyl-2,3,6,7-tetrahydro-1H, 5H-benzo[ij]quinolizin-9-yl)ethenyl]-4H-pyran-4-ylidene}propanedinitrile (abbreviation: BisDCJTM); and SD1 (product name; manufactured by SFC Co., Ltd).

As the light-emitting substance, any of the following phosphorescent compounds can also be used. The following can be given, for example: bis[2-(4',6'-difluorophenyl)pyridinato-N,$C^{2'}$]iridium(III)tetrakis(1-pyrazolyl)borate (abbreviation: FIr6); bis[2-(4',6'-difluorophenyl)pyridinato-N,$C^{2'}$]iridium(III)picolinate (abbreviation: FIrpic); bis[2-(3',5'-bistrifluoromethylphenyl)pyridinato-N,$C^{2'}$]iridium(III)picolinate (abbreviation: $Ir(CF_3ppy)_2(pic)$); bis[2-(4',6'-difluorophenyl)pyridinato-N,$C^{2'}$]iridium(III)acetylacetonate (abbreviation: FIracac); tris(2-phenylpyridinato)iridium(III) (abbreviation: $Ir(ppy)_3$); bis(2-phenylpyridinato)iridium(III) acetylacetonate (abbreviation: $Ir(ppy)_2(acac)$); bis(benzo[h]quinolinato)iridium(III)acetylacetonate (abbreviation: $Ir(bzq)_2(acac)$); bis(2,4-diphenyl-1,3-oxazolato-N,$C^{2'}$)iridium(III)acetylacetonate (abbreviation: $Ir(dpo)_2(acac)$); bis[2-(4'-perfluorophenylphenyl)pyridinato]iridium(III)acetylacetonate (abbreviation: $Ir(p\text{-}PF\text{-}ph)_2(acac)$); bis(2-phenylbenzothiazolato-N,$C^{2'}$)iridium(III)acetylacetonate (abbreviation: $Ir(bt)_2(acac)$); bis[2-(2'-benzo[4,5-α]thienyl)pyridinato-N,$C^{3'}$]iridium(III)acetylacetonate (abbreviation: $Ir(btp)_2(acac)$); bis(1-phenylisoquinolinato-N,$C^{2'}$)iridium(III)acetylacetonate (abbreviation: $Ir(piq)_2(acac)$); (acetylacetonato)bis[2,3-bis(4-fluorophenyl)quinoxalinato]iridium(III) (abbreviation: $Ir(Fdpq)_2(acac)$); (acetylacetonato)bis(2,3,5-triphenylpyrazinato)iridium(III) (abbreviation: $Ir(tppr)_2(acac)$); 2,3,7,8,12,13,17,18-octaethyl-21H,23H-porphyrinplatinum(II) (abbreviation: PtOEP); tris(acetylacetonato)(monophenanthroline)terbium(III) (abbreviation: $Tb(acac)_3(Phen)$); tris(1,3-diphenyl-1,3-propanedionato)(monophenanthroline)europium(III) (abbreviation: $Eu(DBM)_3(Phen)$); tris[1-(2-thenoyl)-3,3,3-trifluoroacetonato](monophenanthroline)europium(III) (abbreviation: $Eu(TTA)_3(Phen)$); and (dipivaloylmethanato)bis(2,3,5-triphenylpyrazinato)iridium(III) (abbreviation: $Ir(tppr)_2(dpm)$).

Note that those light-emitting substances are preferably dispersed in a host material. As the host material, for example, the following can be used: an aromatic amine compound such as NPB (abbreviation), TPD (abbreviation), TCTA (abbreviation), TDATA (abbreviation), MTDATA (abbreviation), or BSPB (abbreviation); a carbazole derivative such as PCzPCA1 (abbreviation), PCzPCA2 (abbreviation), PCzPCN1 (abbreviation), CBP (abbreviation), TCPB (abbreviation), CzPA (abbreviation), 9-phenyl-3-[4-(10-phenyl-9-anthryl)phenyl]-9H-carbazole (abbreviation: PCzPA), or 4-phenyl-4'-(9-phenyl-9H-carbazol-3-yl)triphenylamine (abbreviation: PCBA1BP); a substance having a high hole-transport property which contains a high molecular compound, such as PVK (abbreviation), PVTPA (abbreviation), PTPDMA (abbreviation), or Poly-TPD (abbreviation); a metal complex having a quinoline skeleton or a benzoquinoline skeleton, such as tris(8-quinolinolato)aluminum (abbreviation: Alq), tris(4-methyl-8-quinolinolato)aluminum (abbreviation: $Almq_3$), bis(10-hydroxybenzo[h]-quinolinato)beryllium (abbreviation: $BeBq_2$), or bis(2-methyl-8-quinolinolato)(4-phenylphenolato)aluminum (abbreviation: BAlq); a metal complex having an oxazole-based or triazole-based ligand, such as bis[2-(2-hydroxyphenyl)benzoxazolato]zinc (abbreviation: $Zn(BOX)_2$) or bis[2-(2-hydroxyphenyl)-benzothiazolato]zinc (abbreviation: $Zn(BTZ)_2$); or a substance having a high electron-transport property, such as 2-(4-biphenylyl)-5-(4-tert-butylphenyl)-1,3,4-oxadiazole (abbreviation: PBD), 1,3-bis[5-(p-tert-butylphenyl)-1,3,4-oxadiazol-2-yl]benzene (abbreviation: OXD-7), 9-[4-(5-phenyl-1,3,4-oxadiazol-2-yl)phenyl]carbazole (abbreviation: CO11), 3-(4-biphenylyl)-4-phenyl-5-(4-tert-butylphenyl)-1,2,4-triazole (abbreviation: TAZ), bathophenanthroline (abbreviation: BPhen), or bathocuproine (abbreviation: BCP).

The electron-transport layer is a layer containing a substance with a high electron-transport property. As the substance having a high electron-transport property, for example, a metal complex having a quinoline skeleton or a benzoquinoline skeleton, such as Alq (abbreviation), $Almq_3$ (abbreviation), $BeBq_2$ (abbreviation), or BAlq (abbreviation) can be used. In addition to the above, a metal complex having an oxazole-based or thiazole-based ligand, such as $Zn(BOX)_2$ (abbreviation) or $Zn(BTZ)_2$ (abbreviation) can also be used. Further, besides the metal complex, PBD (abbreviation), OXD-7 (abbreviation), CO11 (abbreviation), TAZ (abbreviation), BPhen (abbreviation), BCP (abbreviation), 2-[4-(dibenzothiophen-4-yl)phenyl]-1-phenyl-1H-benzimidazole (abbreviation: DBTBIm-II), or the like can also be used. The substances mentioned here are mainly ones that have an electron mobility of greater than or equal to $10^{-6}$ $cm^2/Vs$. Note that substances other than those may be used as long as they have an electron-transport property higher than a hole-transport property. Furthermore, the electron-transport layer may have a structure in which two or more layers formed of the above substances are stacked, without limitation to a single-layer structure.

Alternatively, high molecular compounds can be used. For example, poly[(9,9-dihexylfluorene-2,7-diyl)-co-(pyridine-3,5-diyl)] (abbr.: PF-Py), poly[(9,9-dioctylfluorene-2,7-diyl)-co-(2,2'-bipyridine-6,6'-diyl)] (abbr.: PF-BPy), or the like can be used.

The electron-injection layer is a layer containing a substance having a high electron-injection property. As the substance having a high electron-injection property, the following can be given: an alkali metal or an alkaline earth metal such as lithium (Li), cesium (Cs), calcium (Ca), lithium fluoride (LiF), cesium fluoride (CsF), and calcium fluoride ($CaF_2$), and a compound thereof. Alternatively, a layer containing a substance having an electron-transport property and an alkali metal, an alkaline earth metal, or a compound thereof (e.g., Alq containing magnesium (Mg)) can be used. Such a structure makes it possible to increase the efficiency of the electron injection from the cathode 1102.

As a method for forming the organic layer 1103 containing a light-emitting substance by combining these layers as appropriate, any of a variety of methods (e.g., a dry process and a wet process) can be selected as appropriate. For example, a vacuum evaporation method, an inkjet method, a spin coating method, or the like may be selected in accordance with a material to be used. Note that a different formation method may be employed for each layer.

<Material for Charge Generation Region>

The first charge generation region 1104*c* and the second charge generation region are regions containing a substance having a high hole-transport property and an acceptor substance. The charge generation region may not only include a substance having a high hole-transport property and an acceptor substance in the same film but also includes a stacked layer of a layer containing a substance having a high hole-transport property and a layer containing an acceptor substance. Note that in the case of a stacked-layer structure in which the first charge generation region is provided on the cathode side, the layer containing the substance having a high hole-transport property is in contact with the cathode 1102, and in the case of a stacked-layer structure in which the second charge generation region is provided on the anode side, the layer containing the acceptor substance is in contact with the anode 1101.

Note that the acceptor substance is preferably added to the charge generation region so that the mass ratio of the acceptor substance to the substance having a high hole-transport property is greater than or equal to 0.1:1 and less than or equal to 4.0:1.

As the acceptor substance that is used for the charge generation region, a transition metal oxide and an oxide of a metal belonging to Groups 4 to 8 of the periodic table can be given. Specifically, molybdenum oxide is particularly preferable. Note that molybdenum oxide has a low hygroscopic property.

As the substance having a high hole-transport property used for the charge generation region, any of a variety of organic compounds such as an aromatic amine compound, a carbazole derivative, an aromatic hydrocarbon, and a high molecular compound (such as an oligomer, a dendrimer, or a polymer) can be used. Specifically, a substance having a hole mobility of greater than or equal to $10^{-6}$ $cm^2/Vs$ is preferably used. However, other substances than the above described materials may also be used as long as the substances have higher hole-transport properties than electron-transport properties.

<Material for Electron-Relay Layer>

The electron-relay layer 1104*b* is a layer that can immediately receive electrons drawn out by the acceptor substance in the first charge generation region 1104*c*. Therefore, the electron-relay layer 1104*b* is a layer containing a substance having a high electron-transport property, and the LUMO level thereof is positioned between the acceptor level of the acceptor substance in the first charge generation region 1104*c* and the LUMO level of the organic layer 1103 containing a light-emitting substance. Specifically, the LUMO level of the electron-relay layer 1104*b* is preferable about greater than or equal to −5.0 eV and less than or equal to −3.0 eV.

As the substance used for the electron-relay layer 1104*b*, for example, a perylene derivative and a nitrogen-containing condensed aromatic compound can be given. Note that a nitrogen-containing condensed aromatic compound is preferably used for the electron-relay layer 1104*b* because of its stability. Among nitrogen-containing condensed aromatic compounds, a compound having an electron-withdrawing group such as a cyano group or a fluoro group is preferably used because such a compound further facilitates reception of electrons in the electron-relay layer 1104*b*.

As specific examples of the perylene derivative, the following can be given: 3,4,9,10-perylenetetracarboxylic dianhydride (PTCDA), 3,4,9,10-perylenetetracarboxylic bisbenzimidazole (PTCBI), N,N'-dioctyl-3,4,9,10-perylenetetracarboxylic diimide (PTCDI-C8H), N,N'-dihexyl-3,4,9,10-perylenetetracarboxylic diimide (Hex PTC), and the like.

As specific examples of the nitrogen-containing condensed aromatic compound, the following can be given: pirazino[2,3-f][1,10]phenanthroline-2,3-dicarbonitrile (PPDN), 2,3,6,7,10,11-hexacyano-1,4,5,8,9,12-hexaazatriphenylene (HAT $(CN)_6$), 2,3-diphenylpyrido[2,3-b]pyrazine (2PYPR), 2,3-bis(4-fluorophenyl)pyrido[2,3-b]pyrazine (F2PYPR), and the like.

Besides, 7,7,8,8-tetracyanoquinodimethane (abbreviation: TCNQ), 1,4,5,8-naphthalenetetracarboxylic dianhydride (abbreviation: NTCDA), perfluoropentacene, copper hexadecafluorophthalocyanine (abbreviation: $F_{16}CuPc$), N,N'-bis(2,2,3,3,4,4,5,5,6,6,7,7,8,8,8-pentadecafluorooctyl)-1,4,5,8-naphthalenetetracarboxylic diimide (abbreviation: NTCDI-C8F), 3',4'-dibutyl-5,5"-bis(dicyanomethylene)-5,5"-dihydro-2,2':5',2"-terthiophen (abbreviation: DCMT), methanofullerenes (e.g., [6,6]-phenyl $C_{61}$ butyric acid methyl ester), or the like can be used for the electron-relay layer 1104*b*.

<Material for Electron-Injection Buffer>

The electron-injection buffer 1104*a* is a layer which facilitates electron injection from the first charge generation region 1104*c* into the organic layer 1103 containing a light-emitting substance. The provision of the electron-injection buffer 1104*a* between the first charge generation region 1104*c* and the organic layer 1103 containing a light-emitting substance makes it possible to reduce the injection barrier therebetween.

A substance having a high electron-injection property can be used for the electron-injection buffer 1104*a*. For example, an alkali metal, an alkaline earth metal, a rare earth metal, a compound thereof (e.g., an alkali metal compound (including an oxide such as lithium oxide, a halide, and carbonate such as lithium carbonate or cesium carbonate), an alkaline earth metal compound (including an oxide, a halide, and carbonate), or a rare earth metal compound (including an oxide, a halide, and carbonate)) can be used.

Further, in the case where the electron-injection buffer 1104*a* contains a substance having a high electron-transport property and a donor substance, the donor substance is preferably added so that the mass ratio of the donor substance to the substance having a high electron-transport property is greater than or equal to 0.001:1 and less than or equal to 0.1:1. Note that as the donor substance, an organic compound such as tetrathianaphthacene (abbreviation: TTN), nickelocene, or decamethylnickelocene can be used as well as an alkali metal, an alkaline earth metal, a rare earth metal, a compound of the above metal (e.g., an alkali metal compound (including an oxide of lithium oxide or the like, a halide, and carbonate such as lithium carbonate or cesium carbonate), an alkaline earth metal compound (including an oxide, a halide, and carbonate), and a rare earth metal compound (including an oxide, a halide, and carbonate). Note that as the substance having a high electron-transport property, a material similar to the above-described material for the electron-transport layer which can be formed in part of the organic layer 1103 containing a light-emitting substance can be used.

The light-emitting element described in this embodiment can be fabricated by combination of the above-described materials. Light emission from the above-described light-emitting substance can be obtained with this light-emitting element, and the emission color can be selected by changing the type of the light-emitting substance. Further, a plurality of light-emitting substances which emit light of different colors can be used, whereby, for example, white light emission can also be obtained by expanding the width of the emission spectrum. Note that in order to obtain white light emission, light-emitting substances which emit light whose colors are complementary may be used, for example, different layers which emit light whose colors are complementary or the like can be used. Specific examples of complementary colors include "blue and yellow", "blue-green and red", and the like.

Note that this embodiment can be appropriately combined with any of the other embodiments described in this specification.

This application is based on Japanese Patent Application Serial No. 2010-248719 filed with Japan Patent Office on Nov. 5, 2010, the entire contents of which are hereby incorporated by reference.

What is claimed is:

1. A lighting device comprising:

a light-emitting body comprising an optical member, a sealing member, at least a first terminal and a second terminal, a light-emitting element sealed between the optical member and the sealing member, and a magnetic member; and a mounting portion comprising a magnet, an elastic body, and at least a first contact and a second contact, wherein the magnet and each of the first contact and the second contact are spaced from each other, wherein the elastic body is configured to distance the magnet from the magnetic member in the light-emitting body, wherein the first terminal and the second terminal are configured to be in contact with the first contact and the second contact, respectively, and wherein the light-emitting body is configured to be detachably fixed to the mounting portion by the magnet and the magnetic member.

2. The lighting device according to claim 1, wherein each of a height of the first contact and a height of the second contact is variable by contact between the light-emitting body and the first contact or the second contact.

3. The lighting device according to claim 1, wherein the magnetic member is fixed to the optical member or the sealing member.

4. The lighting device according to claim 1, wherein the sealing member comprises the magnetic member.

5. The lighting device according to claim 1, wherein the magnetic member comprises iron, cobalt, or manganese.

6. A lighting device comprising:

a light-emitting body comprising an optical member, a sealing member, at least a first terminal and a second terminal, a light-emitting element sealed between the optical member and the sealing member, and a magnetic member;

a mounting portion comprising a magnet, an elastic body and at least a first contact and a second contact; and a spacer on the mounting portion, the spacer being in contact with the light-emitting body, wherein the magnet and each of the first contact and the second contact are spaced from each other, wherein the elastic body is configured to distance the magnet from the magnetic member in the light-emitting body, wherein the first terminal and the second terminal are configured to be in contact with the first contact and the second contact, respectively, wherein the light-emitting body is configured to be detachably fixed to the mounting portion by the magnet and the magnetic member, and wherein a height of the spacer is higher than a height of the magnet.

7. The lighting device according to claim 6, wherein each of a height of the first contact and a height of the second contact is variable by contact between the light-emitting body and the first contact or the second contact.

8. The lighting device according to claim 6, wherein the magnetic member is fixed to the optical member or the sealing member.

9. The lighting device according to claim 6, wherein the sealing member comprises the magnetic member.

10. The lighting device according to claim 6, wherein the magnetic member comprises iron, cobalt, or manganese.

11. The lighting device according to claim 6, wherein a distance between the magnet and the magnetic member is less than or equal to 10 mm.

12. A lighting device comprising:

a light-emitting body comprising an optical member, a sealing member, at least a first terminal and a second terminal, a light-emitting element sealed between the optical member and the sealing member, and a magnetic member;

a mounting portion comprising a magnet, at least a first contact and a second contact, a sliding mechanism of the magnet, an elastic body, and a switch, wherein the elastic body is configured to distance the magnet from the magnetic member in the light-emitting body, wherein the first terminal and the second terminal are configured to be in contact with the first contact and the second contact, respectively, wherein the light-emitting body is configured to be detachably fixed to the mounting portion by the magnet and the magnetic member, and wherein the switch is configured to supply power to the light-emitting body through the first contact and the second contact in accordance with a position of the magnet

13. The lighting device according to claim 12, wherein each of a height of the first contact and a height of the second contact is variable by contact between the light-emitting body and the first contact or the second contact.

14. The lighting device according to claim 12, wherein the magnetic member is fixed to the optical member or the sealing member.

15. The lighting device according to claim 12, wherein the sealing member comprises the magnetic member.

16. The lighting device according to claim 12, wherein the magnetic member comprises iron, cobalt, or manganese.

* * * * *

UNITED STATES PATENT AND TRADEMARK OFFICE

CERTIFICATE OF CORRECTION

PATENT NO. : 8,727,586 B2
APPLICATION NO. : 13/289720
DATED : May 20, 2014
INVENTOR(S) : Wakimoto It is certified that error appears in the above-identified patent and that said Letters Patent is hereby corrected as shown below:

In the Specification:

Column 1, Line 26; delete “foamed.” and insert --formed.--.

Column 20, Lines 10 to 12; delete “poly[N-(4-{4-(4-diphenylamino)phenyl]phenyl-N'-phenylamino}phenyl)methacrylamide]” and insert --poly[N-(4-(N'-[4-(4-diphenylamino)phenyl]phenyl-N'-phenylamino}phenyl)methacrylamide]--.

Column 21, Line 59; delete “triazole-based” and insert --thiazole-based--.

Signed and Sealed this
Twenty-third Day of September, 2014

Michelle K. Lee

Michelle K. Lee
*Deputy Director of the United States Patent and Trademark Office*